US006264194B1

(12) United States Patent
Hayashi et al.

(10) Patent No.: US 6,264,194 B1
(45) Date of Patent: Jul. 24, 2001

(54) SHEET HANDLING DEVICE AND IMAGES FORMING APPARATUS USING THE DEVICE

(75) Inventors: Kenichi Hayashi, Kashiwa; Katsuaki Hirai, Moriya-machi, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,853

(22) Filed: Nov. 8, 1999

(30) Foreign Application Priority Data

Nov. 11, 1998 (JP) ..... 10-320917

(51) Int. Cl.[7] ..... B65H 31/26

(52) U.S. Cl. ..... 271/220; 271/221; 271/213; 271/314; 270/58.12

(58) Field of Search ..... 271/220, 314, 271/213, 176, 207, 221; 270/58.08, 58.12, 58.17, 58.11, 58.27

(56) References Cited

U.S. PATENT DOCUMENTS

| | | | | |
|---|---|---|---|---|
| 5,406,358 | | 4/1995 | Kimura et al. | 355/271 |
| 5,465,949 | | 11/1995 | Kamada et al. | 271/110 |
| 5,573,233 | | 11/1996 | Hirai et al. | 270/58.08 |
| 5,622,359 | * | 4/1997 | Kawano et al. | 270/58.12 |
| 5,671,917 | | 9/1997 | Choho et al. | 271/111 |
| 5,762,328 | * | 6/1998 | Yamada et al. | 270/58.11 X |
| 5,897,250 | | 4/1999 | Hirai et al. | 399/404 |
| 5,911,414 | | 6/1999 | Kato et al. | 270/58.07 |
| 5,931,460 | * | 8/1999 | Kadowaki et al. | 270/58.12 X |
| 5,992,839 | * | 11/1999 | Kosasa | 270/58.12 |

FOREIGN PATENT DOCUMENTS

| | | | |
|---|---|---|---|
| 2-144370 | | 6/1990 | (JP) . |
| 405278928A | * | 10/1993 | (JP) . |

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

A sheet handling device includes an ejection device for ejecting sheets; a stack device for stacking thereon the sheets ejected by the ejection device and having a stopper portion for supporting the ends of the sheets; a rotatable feeding member shaped like an endless belt for making contact with the sheets stacked on the stack device to pull the sheets toward the stopper portion; an aligning device for aligning the sheets on the stack device by moving the sheets in the direction orthogonal to the sheet feeding direction; a shift device for moving the endless feeding member between the acting position to act on the surface of the sheets on the stack device and the retracted position to separate from the sheet surface or to reduce the force acting on the sheet surface; and a control device for exerting control so that the endless feeding member is retracted to the retracted position during the aligning operation by the aligning device.

16 Claims, 25 Drawing Sheets

VIEWED FROM DIRECTION OF ARROW X

VIEWED FROM DIRECTION OF ARROW X

SHEET HANDLING DEVICE AND IMAGES FORMING APPARATUS USING THE DEVICE

BACKGROUND OF THE INVENTION

1. Field of the Invention

The present invention relates to a sheet handling device, and more particularly, to a sheet handling device adapted to align and fasten ejected sheets having images formed on the surfaces thereof by an image forming apparatus, such as a copying machine or a laser beam printer, and in particular, to collect sheets into a stack and effectively align the stack of sheets by an aligning means in a sheet aligning operation. The present invention also relates to an image forming apparatus having the sheet handling device.

2. Description of the Related Art

Hitherto, numerous image forming apparatuses have been proposed, for example, in Japanese Laid-Open Patent Application No. 2-144370, which are equipped with a first handling means (hereinafter referred to as a "handling tray") for aligning and collecting sheets having images thereon into a stack and for stapling a part of the sheet stack as necessary, and a second handling means (hereinafter referred to as a "stack tray") for receiving and holding sheet stacks which have been aligned or stapled.

FIG. 34 schematically shows the configuration of an aligning section in this kind of conventional sheet handling device.

Referring to FIG. 34, the conventional sheet handling device comprises a pair of feeding rollers 701 consisting of a lower feeding roller 701*a* and a feeding roller 701*b* for feeding sheets from a sort path, a handling tray unit 800 for receiving the conveyed sheets, and a stack tray 900 for holding stacks of sheets ejected in stacks after processing.

Knurl belts 702 are wound on the lower feeding roller 701*a* of the pair of feeding rollers 701 at several positions in the axial direction between the lower feeding roller 701*a* and the feeding roller 701*b*. Sheet guides 703 are placed at appropriate positions between the knurl belts 702.

The handling tray unit 800 comprises a handling tray 801 inclined so that the downstream side in the sheet ejecting direction (the upper left side in FIG. 34) is placed on the upper side and the upstream side (the lower right side in FIG. 34) is placed on the lower side, a rear end stopper 802 disposed at the upstream end of the handling tray 801, a pair of aligning members 803 disposed on the right and left sides in the sheet width direction, a pair of stack ejection rollers 804 composed of lower and upper stack ejection rollers 804*a* and 804*b* disposed on the downstream side of the handling tray 801, a pivoting guide 805 for supporting the upper stack ejection roller 804*b* at the leading end on the lower surface so that the upper stack ejection roller 804*b* can make contact with and separate from the lower stack ejection roller 804*a*, and a pull-in paddle 806 disposed in the upper middle section.

In this case, the lower and upper stack ejection rollers 804*a* and 804*b* are allowed by the control of pivoting of the pivoting guide 805 to receive sheets P from the feeding rollers 701 into the handling tray 801 in the state in which the upper stack ejection roller 804*b* is separated from the lower stack ejection roller 804*a*.

The sheets P are continuously pulled back by the rotational driving of the pull-in paddle 806, are aligned by the action of the aligning members 803, and are put into contact with the rear end stopper 802 via the sheet guides 703 by the action of the counterclockwise rotation of the knurl belts 702 for feeding the ends of the sheets, whereby the aligning operation is completed.

Subsequently, the sheets aligned in the handling tray 801 are subjected to stapling or other processes at the aligning position, and are ejected in a stack into the stack tray 900 by putting the upper stack ejection roller 804*b* into contact with the lower stack ejection roller 804*a* and rotating the lower stack ejection roller 804*a* counterclockwise.

In the above-described conventional structure, however, as the number of sheets P stacked in the handling tray 801 increases, the contact pressure of the knurl belts 702 with the sheets P also increases. Therefore, the pulling force toward the rear end stopper 802 increases, whereas an increased resistance is applied to the movement of the aligning members 803 in the aligning direction orthogonal thereto. As shown in FIG. 35, the knurl belts 702 first follow a sheet $P_1$ moved by the aligning members 803 and are bent and tilted on the nip between the knurl belts 702 and the rollers 701*b*, but the knurl belts 702 cannot follow further movement of the sheet $P_1$, whereby slip occurs therebetween. Therefore, when the stiffness of the sheet $P_1$ is less than the slide resistance, the sheet $P_1$ is raised, as shown by a broken line Pa (at worst, it is buckled), and does not reach a reference position 803*a*, which may cause misalignment.

SUMMARY OF THE INVENTION

Accordingly, it is an object of the present invention to provide a sheet handling device and an image forming device having the device, and more particularly, to provide a sheet handling device which prevents interference between the pulling operation of a sheet on a stack means to a stopper means by an endless feeding member and the aligning operation by an aligning means, and which prevents failure in stacking sheets due to the interference.

In order to achieve the above object, according to one aspect of the present invention, there is provided a sheet handling device including: an ejection device for ejecting sheets; a stack device for stacking thereon the sheets ejected by the ejection device, and having a stopper portion for supporting the ends of the sheets; a rotatable feeding member shaped like an endless belt for making contact with the sheets stacked on the stack device and to pull the sheets toward the stopper portion; an aligning device for aligning the sheets on the stack device by moving the sheets in the direction orthogonal to the sheet feeding direction; a shift device for moving the endless feeding member between the acting position to act on the surface of the sheets on the stack device and the retracted position to separate from the sheet surface or to reduce the force acting thereat; and a control device for exerting control so that the endless feeding member is retracted to the retracted position during the aligning operation by the aligning device.

Preferably, the shift device is a pulling device, and the endless feeding member at the retracted position is pulled by the pulling device so as not to be in contact with the sheets on the stack device.

Preferably, the shift device is a pulling device, and the endless feeding member at the retracted position is pulled by the pulling device so as to be in slight contact with the sheets on the stack device.

Preferably, the aligning device makes a forward motion for pushing the sheets to the aligning position, and a reverse motion for separating from the aligning position. The endless feeding member is shifted to the retracted position during the pushing of the aligning device, and to the acting position during the reverse motion.

The sheet handling device may further include a counting device for counting the number of sheets ejected in the stack device, wherein, when the number of sheets on the stack device counted by the counting device exceeds a predetermined number, the control device is activated during the aligning operation so as to shift the endless feeding member to the retracted position.

According to the above structure, sheets ejected into the stack device by the ejection device are pulled to the stopper portion at the end of the sheets by the endless feeding member, and are aligned by being shifted in the direction orthogonal to the sheet feeding direction by the aligning device. During the aligning operation by the aligning device, the endless feeding member is shifted from the acting position in contact with the sheets to the retracted position so as to separate from the sheets or to reduce the force acting on the sheets. Therefore, it is possible to reduce the load of the endless feeding member on the sheets during alignment, to stabilize the aligning operation, and to improve sheet stacking ability.

During the reverse motion of the aligning device, the endless feeding member can act on the sheets to pull the sheets to the stopper portion, which improves sheet aligning ability at the stopper portion.

Further objects, features, and advantages of the present invention will become apparent from the following description of the preferred embodiments with reference to the attached drawings.

DESCRIPTION OF THE PREFERRED EMBODIMENTS

The preferred embodiments of a sheet handling device and an image forming apparatus having the sheet handling device according to the present invention will be described below in detail with reference to FIGS. 1 to 33. Throughout the drawings, like reference numbers indicate like items, unless otherwise specified.

First, description will be given of an image forming apparatus according to the present invention, which is equipped with a sheet handling device.

Figure 33:
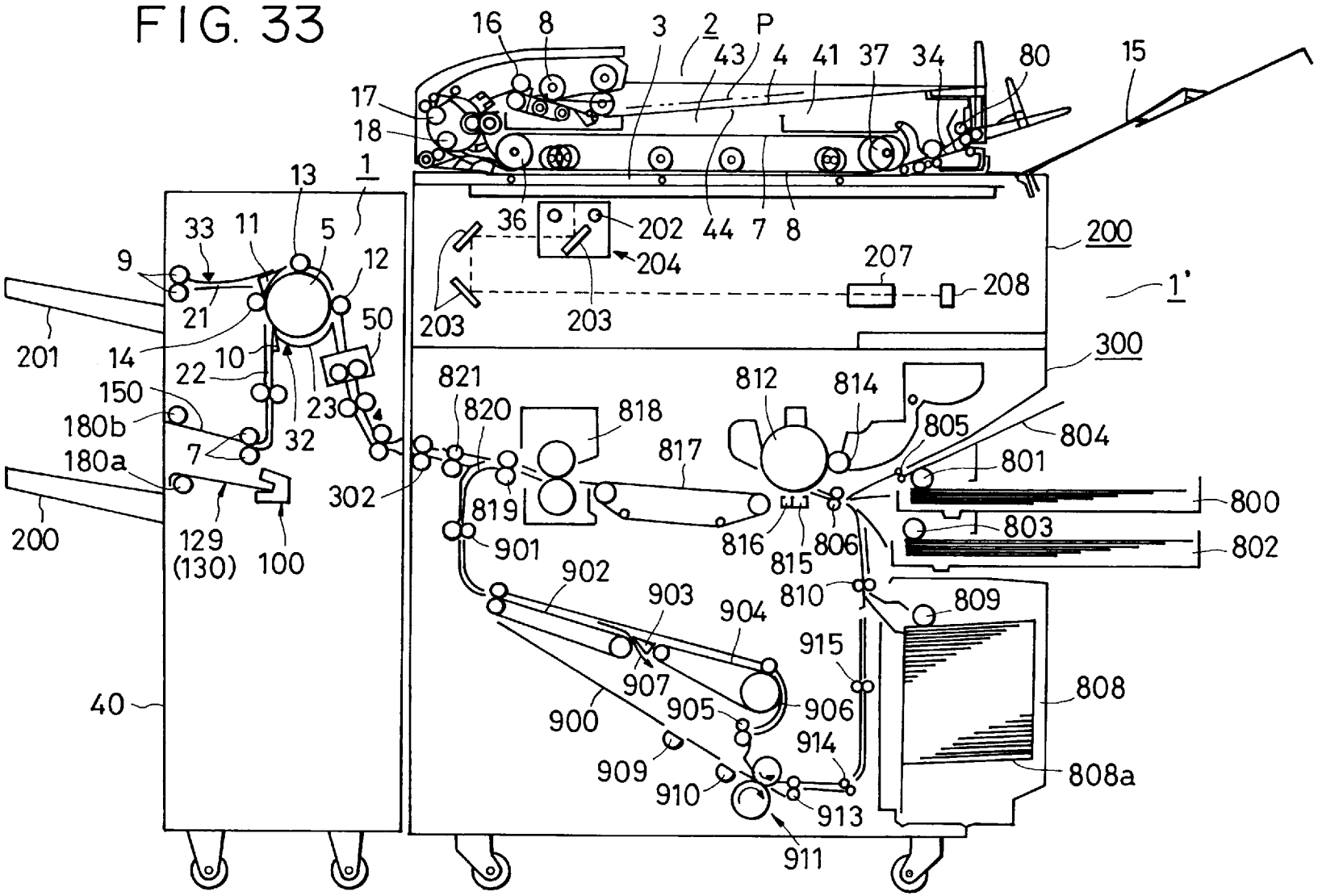
FIG. 33 is a longitudinal sectional front view of an image forming apparatus having the sheet handling device of the present invention.
Figure 34:
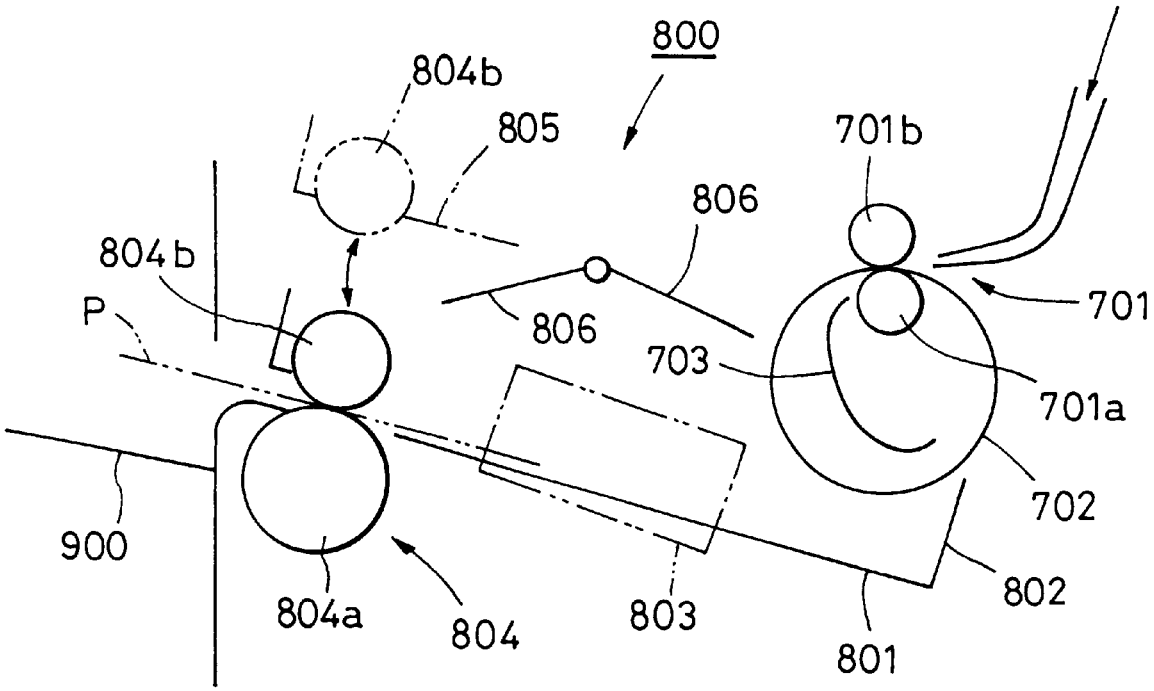
FIG. 34 RELATED ART
FIG. 34 is a longitudinal sectional side view schematically showing the configuration of a sheet aligning section in a conventional sheet handling device.
Figure 35:
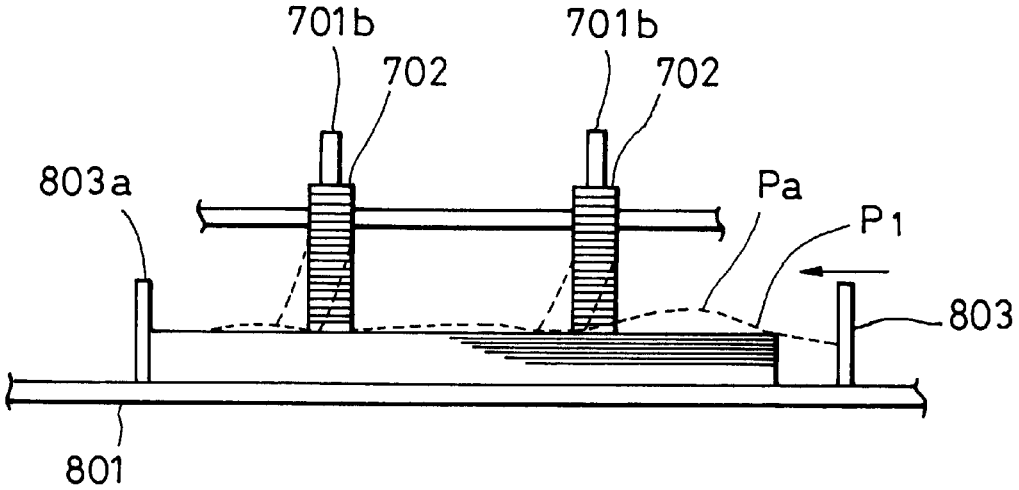
FIG. 35 RELATED ART
FIG. 35 is a front view of the sheet aligning section.

FIG. 33 is a longitudinal sectional front view of an image forming apparatus having a sheet handling device of the present invention. Referring to FIG. 33, an automatic document feeder (ADF) 2 serving as a document feeding device (sheet feeding device) has a document tray 4 in the upper part, and a wide belt 7 wound on a driving roller 36 and a turn roller 37 disposed on opposite sides in the lower part. Documents (sheets) P laid on the document tray 4 are sequentially separated and delivered from the uppermost one by a separation means, and are conveyed onto a platen glass (platen) 3 at a reading position (image reading position) in a copying machine body 1' serving as the main body of the image forming apparatus. Numerals 8, 16, 17, and 18 denote rollers.

The wide belt 7 is in contact with the platen 3 so as to turn in forward and reverse directions, and serves to place a document P conveyed from the document tray 4 at a predetermined position on the platen 3, and to carry a document P on the platen 3 out onto an ejection tray 15. Documents P are placed on the document tray 4 from the top in the order of page 1 (page 2), page 3 (page 4), . . . .

The copying machine body 1' is composed of an image input section 200 (hereinafter referred to as a "reader section"), and an image output section 300 (hereinafter referred to as a "printer section").

The reader section 200 optically reads and photoelectrically converts image information recorded on a document P, and inputs the information as image data. The reader section 200 comprises a scanner unit 204 including the platen 3, a lamp 202, and mirrors 203, a lens 207, an image sensor 208, and the like.

Next, the printer section 300 serving as the image output section will be described. The printer section 300 is an image forming means using well-known electrophotography.

In the printer section 300, sheets in an upper cassette 800 are separated and delivered one by one by the action of separation claws (not shown) and a delivery roller 801, and are guided to register rollers 806. Sheets in a lower cassette 802 are similarly separated and delivered one by one by the action of separation claws (not shown) and a delivery roller 803, and are guided to the register rollers 806. A manual feed guide 804 guides sheets one by one to the register rollers 806 via rollers 805. A sheet stack device (of the deck type) 808 has an intermediate plate 808*a* that is moved up and down by a motor or the like. Sheets on the intermediate plate 808*a* are separated and delivered one by one by a delivery roller 809 and separation claws (not shown), and are guided to feeding rollers 810.

A photoconductive drum 812, a developing device 814, a transfer charger 815, and a separation charger 816 constitute an image forming section.

The printer section 300 further comprises a conveyor belt 817 for conveying a sheet with an image formed thereon, a fixing device 818, feeding rollers 819, and a flapper 820. Sheets having images formed thereon are guided to main body ejection rollers (main body ejection means) 821 by the flapper 820, and are ejected into a sheet handling device 1 disposed on the downstream side.

The number of images corresponding to the set number of copies with respect to a single document placed on the platen 3 are formed on the photoconductive drum 812, and the number of sheets corresponding to the number of copies are delivered from any of the cassettes 800, 802 and the deck 808 each time one image is formed on the photoconductive drum 812. Registration of the image on the photoconductive drum 812 and the sheet is performed by the register rollers 806.

When a required number of copies is made, the document is ejected from the platen 3, and the next document is positioned on the platen 3. Subsequent operations are performed in the same manner as above.

In a case in which images are formed on both sides of a sheet material (double-sided copying), or in a case in which multiple images are superimposed on one side of a sheet (multiple copying), an intermediate tray 900 temporarily holds the sheet having images formed thereon. Numerals 901, 902, 903, 904, and 905 respectively denote feeding rollers, a conveyor belt, a flapper, a conveyor belt, and feeding rollers. In the case of double-sided copying, a sheet is guided to the intermediate tray 900 through a path 906, so that the image plane of the sheet faces up. In the case of multiple copying, a sheet material is guided to the intermediate tray 900 through a path 907, so that the image plane thereof faces down.

Sheet materials laid on the intermediate tray 900 are separated and delivered again one by one from the lowermost one by the action of auxiliary rollers 909 and 910 and a pair of separation rollers 911 rotating in opposite directions. The redelivered sheet materials are guided to the image forming section via feeding rollers 913, 914, and 915, the rollers 810, and the register rollers 806, and are ejected after image formation in a manner similar to the above.

Copies are first made on one side of the number of sheets corresponding to the set number of copies with respect to a single document placed on the platen 3, and the sheets are stacked in the intermediate tray 900. Subsequently, the document on the platen 3 is turned upside down and is placed again on the platen 3, and an image on the document is read a number of times corresponding to the number of copies. Each time the image is read, it is copied on a sheet redelivered from the intermediate tray 900. In contrast, another method is available in which only a set of copies are made each time a document is circulated by the ADF 2. According to this method, since a plurality of sets of copies arranged in page order can be sequentially obtained, a required number of sets of copies can be obtained in a sorted manner without using a sorter. When double-sided copying is performed in this method, images on both sides of a single document are successively read, and are copied on both sides of a sheet, and the sheet is ejected. Subsequently, both sides of the next document are subjected to the same process. By repeating these operations a plurality of times, a plurality of sets of double-sided copies can be made in a sorted manner.

Sheets with images formed thereon are ejected from the copying machine body 1' to the sheet handling device (also referred to as a "finisher") 1 by main body ejection rollers (main body ejection means) 302.

The sheets conveyed from the copying machine body 1' are ejected into a sample tray 201 by a pair of second ejection rollers 9 via a buffer roller 5, a first switch flapper 11, and a non-sort mode path 21 in a non-sort mode, and are temporarily placed onto a handling tray 130 serving as an intermediate tray by a pair of first ejection rollers 7 via the buffer roller 5, a second switch flapper 10, and a sort mode path 22 in a sort mode. The sheets stacked in the handling tray 130 are aligned on both sides in the direction intersecting the sheet feeding direction by an aligning member (not shown). As necessary, the sheets are fastened at the rear end by a stapler 100 (101), and are ejected into a stack tray 200 by a pair of stack ejection rollers 180*a* and 180*b*.

Next, the sheet handling device 1 according to an embodiment of the present invention will be described.

Outline of Sheet Handling Device

First, description will be given of principal constituents of the sheet handling device 1.

Figure 1:
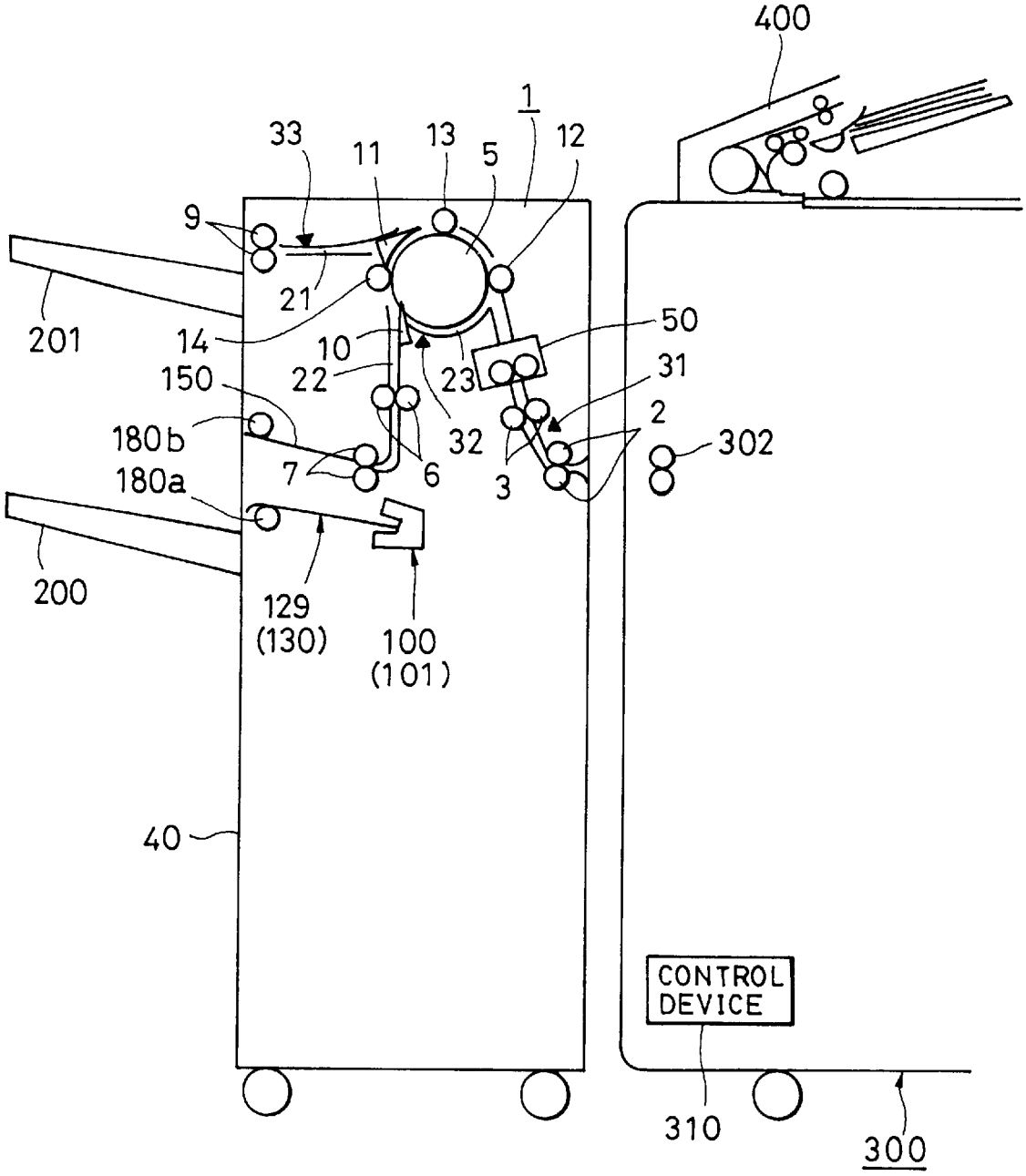
FIG. 1 is a longitudinal sectional front view showing the overall configuration of a sheet handling device according to the present invention.

FIG. 1 is a schematic sectional view showing the overall configuration of the sheet handling device 1. Numeral 400 in FIG. 1 denotes an RDF.

The sheet handling device (finisher) 1 shown in FIG. 1 comprises a pair of input rollers 2 for receiving a sheet P ejected from the main body ejection rollers 302 of the image forming apparatus 300, a pair of first feeding rollers 3 for feeding the received sheet P, an input-side sheet detection sensor (counting means) 31 for detecting the sheet P being traveled, a punching unit 50 for punching adjacent to the rear end of the fed sheet, the buffer roller 5 having a relatively large diameter and placed in the feeding path so as to feed the sheet P by pressing the sheet P against pressing rollers 12, 13, and 14 arranged therearound.

The first switch flapper 11 selectively switches between the non-sort path 21 and the sort path 22. The second switch flapper 10 switches between the sort path 22 and a buffer path 23 for temporarily holding a sheet P. A sensor 33 detects a sheet in the non-sort path 21, and a sensor 32 detects a sheet in the buffer path 23.

A pair of second feeding rollers 6 are disposed in the sort path 22. A handling tray unit 129 having a handling tray (stack means) 130 serves to temporarily collect and align sheets P. and to perform stapling with a stapler 101 in a stapling unit 100 (fastening means). At the ejection end of the handling tray 130, one of a pair of stack ejection rollers (stack transfer means), that is, a lower ejection roller 180*a* on the fixed side, is placed. The first ejection rollers 7 are disposed in the sort path 22 so as to eject sheets onto the handling tray 130 serving as a first stack tray, and the second ejection rollers 9 are disposed in the non-sort path 21 so as to eject sheets onto the sample tray 201.

An upper ejection roller 180*b* supported by a pivoting guide 150 makes pressing contact with the lower ejection roller 180*a* when the pivoting guide 150 is placed into the closed position, thereby ejecting sheets in the handling tray 130 into the stack tray (second stack tray) 200. A stack guide 40 supports the rear ends (in the stack ejecting direction) of sheets stacked in the stack tray 200 and the sample tray 201, and also serves as an exterior of the sheet handling device 1.

Detailed Description of Stapling Unit

Next, the stapling unit (fastening means) 100 will be described in detail, in particular, with reference to FIG. 2 (a side view of the principal part), FIG. 3 (a plan view as seen from the direction of the arrow "a" in FIG. 2), and FIG. 4 (a rear view as seen from the arrow "b" in FIG. 2).

In the stapling unit 100 (fastening means), the stapler 101 is fixed onto a movable carriage 103 via a holder 102.

The movable carriage 103 has a pair of stud shafts 104 and 105 fixed in parallel with the rear ends of the sheets stacked in the handling tray 130. Rolling rollers 106 and 107 are rotatably assembled with the stud shafts 104 and 105, and are movably engaged with a series of hole-shaped guide rails 108*a*, 108*b*, and 108*c* bored in a fixed stand 108 similarly in parallel.

The rolling rollers 106 and 107 have flanges 106*a* and 107*a* having a larger diameter than the width of the hole-shaped guide rails 108*a*, 108*b*, and 108*c*. On the other hand, support rollers 109 are provided at three positions on the lower surface of the movable carriage 103 for holding the stapler 101, and the movable carriage 103 moves on the fixed stand 108 along the hole-shaped guide rails 108*a*, 108*b*, and 108*c*.

Figure 3:
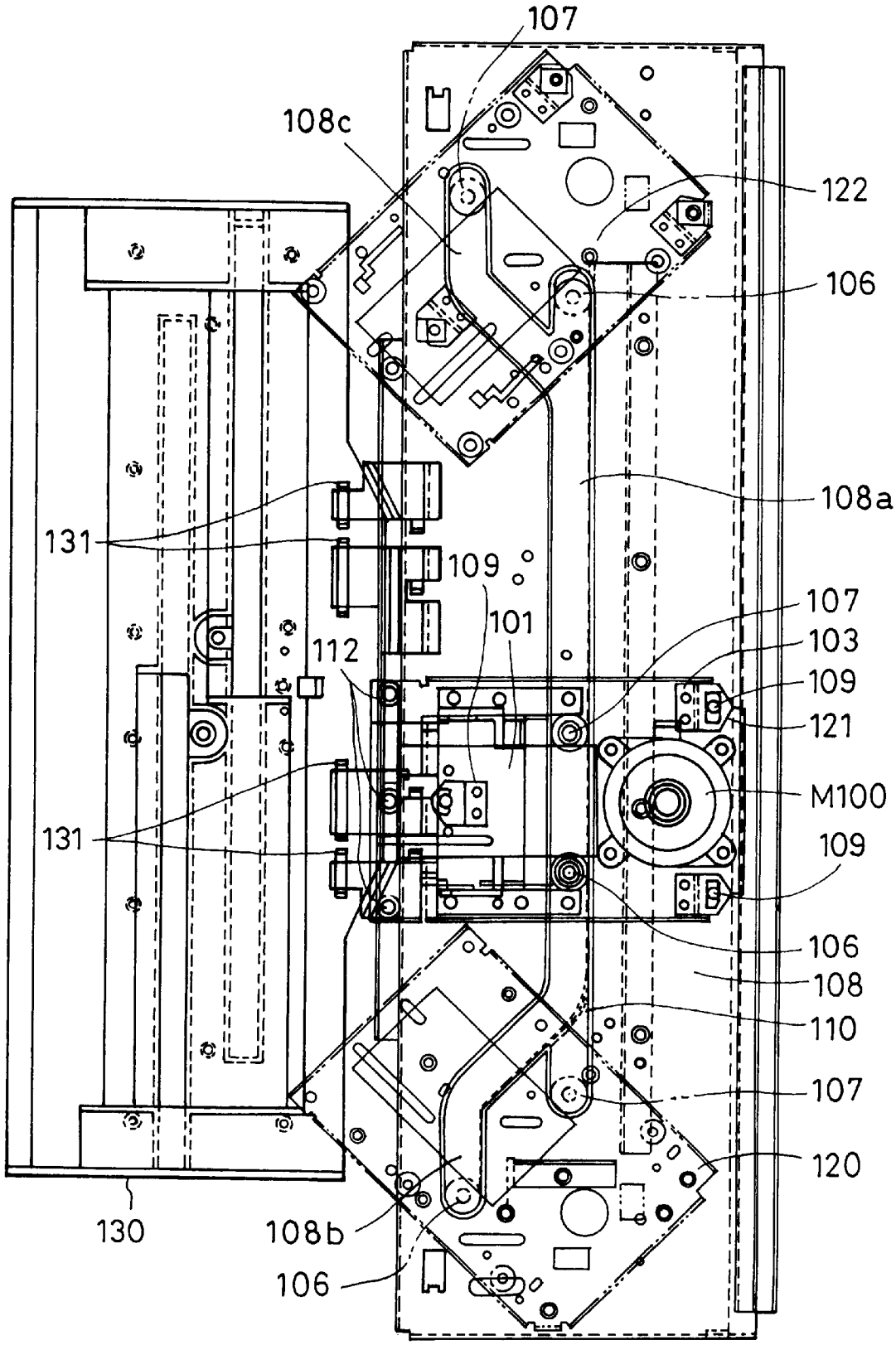
FIG. 3 is a plan view of a stapler in the stapling unit, as seen from the direction of the arrow "a" in FIG. 2.
Figure 4:
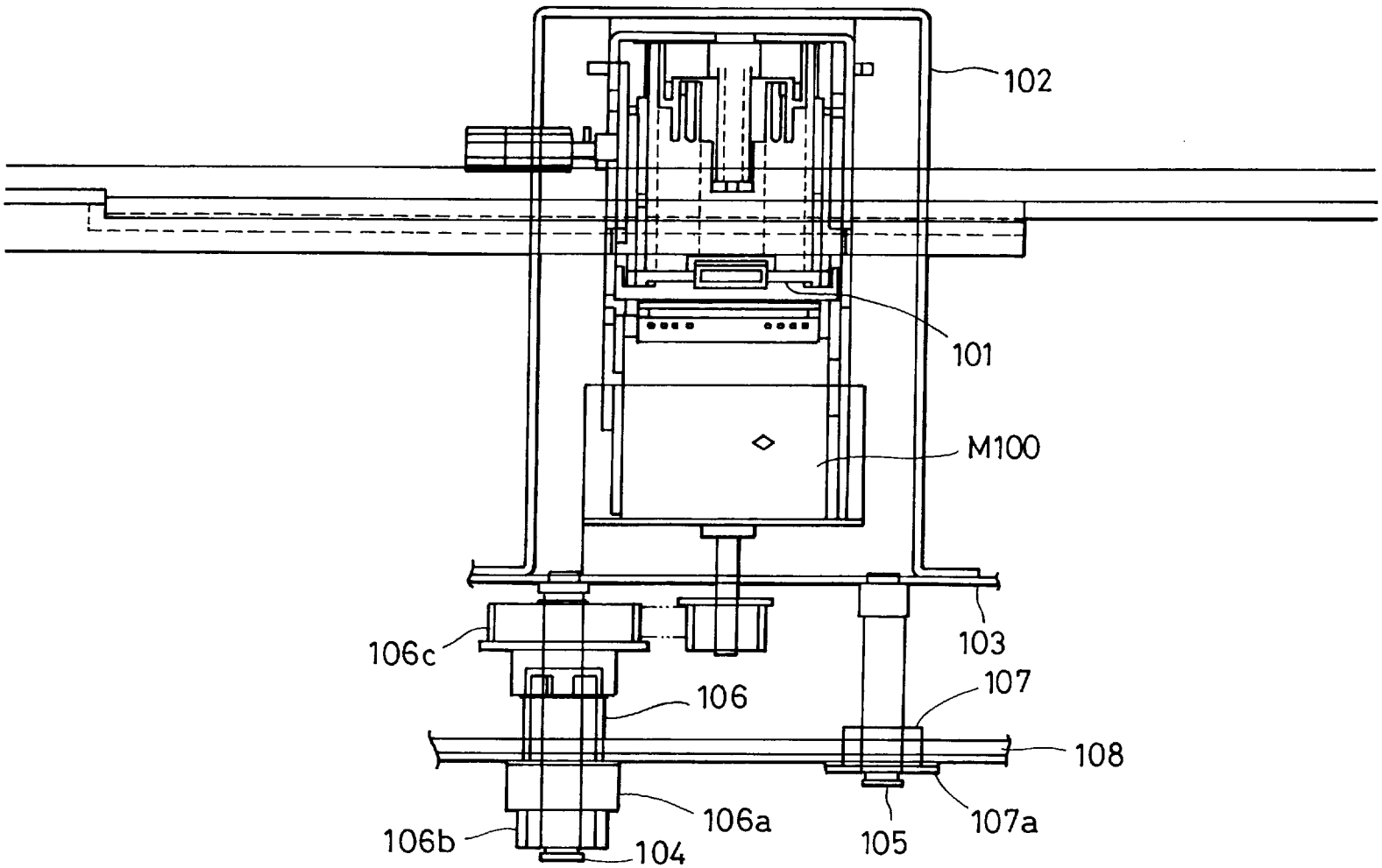
FIG. 4 is a rear view of the stapler, as seen from the direction of the arrow "b" in FIG. 2.

As shown in FIG. 3, the guide rails 108*a*, 108*b*, and 108*c* are shaped to include a main guide rail hole section (108*a*), a left end guide rail hole section (108*b*) branching off from the left end of the section 108*a* and extending in parallel therewith, and a right end guide rail hole section (108*c*) branching off from the right end of the section 108*a* and extending in parallel therewith. Because of the rail shape of the sections, when the stapler 101 is placed at the left end 120, the rolling roller 106 is moved into the left end of the rail hole section 108*b*, and the rolling roller 107 is moved into the left end of the rail hole section 108*a*, so that the stapler 101 is held in a position inclined to the right at a predetermined angle. When the stapler 101 is placed at the center 121, the rolling rollers 106 and 107 are placed inside the rail hole 108*a* so that the stapler 101 is held in a parallel position where it is not inclined. When the stapler 101 is placed at the right end 122, the rolling roller 107 is moved into the right end of the rail hole section 108*c*, and the rolling roller 106 is moved into the right end of the rail hole section 108*a* so that the stapler 101 is held in a position inclined to the left at a predetermined angle. Such changes in position of the stapler 101 are made by the action of a shift cam (not shown).

The stapling unit 100 further includes a position sensor (not shown) for detecting the home position of the stapler 101. The stapler 101 usually stands by in the home position on the left side.

Detailed Description of Stapler Shift Mechanism

Next, a shift mechanism for the stapler 101 will be described in detail.

One of the rolling rollers 106 of the movable carriage 103 is integrally provided with a pinion gear 106*b* below the flange 106*a*, and with a belt pulley 106*c* thereabove. The pinion gear 106*b* is connected to an output pulley of a driving motor M100 above the movable carriage 103 via a driving belt passing between the output pulley and the belt pulley 106*c*, and is meshed with a rack gear 110 fixed to the fixed stand 108 along the rail hole sections, whereby the movable carriage 103 is allowed to move together with the stapler 101 in the sheet width direction in response to the forward and reverse rotations of the driving motor M100.

A stud shaft 111 extending downward from the lower surface of the movable carriage 103 is provided with stopper turning rollers 112. Although the details will be described later, the stopper turning rollers 112 serve to turn rear end stoppers (stopper portions) 131 of the handling tray 130 in order to prevent the rear end stoppers 131 and the stapler 101 from colliding.

Detailed Description of Rear End Stoppers

Next, a detailed description will be given of the rear end stoppers 131 for supporting the rear ends of sheets in the handling tray 130.

Each of the rear end stoppers 131 is formed to stand perpendicularly to the holding surface of the handling tray 130, and has an abutting support surface 131*a* for supporting the rear ends of the sheets in abutting contact therewith. The abutting support surface 131*a* pivots on a pivot pin 131*b* on the lower side of the handling tray 130 in the downward direction shown by the arrow in FIG. 2. A main link 132 having a cam surface 132*a*, which is pressed by contact with the stopper turning roller 112, is placed in contact with an abutting plate 136, pivots on a shaft 134 fixed to a frame or the like (not shown) against a tension spring 135. A pin 132*b* at the top thereof is slidably engaged with a slot formed at one end of a connecting link 133 that is pivotally supported at the other end by a pin 131*c* on the rear end stopper 131.

Figure 2:
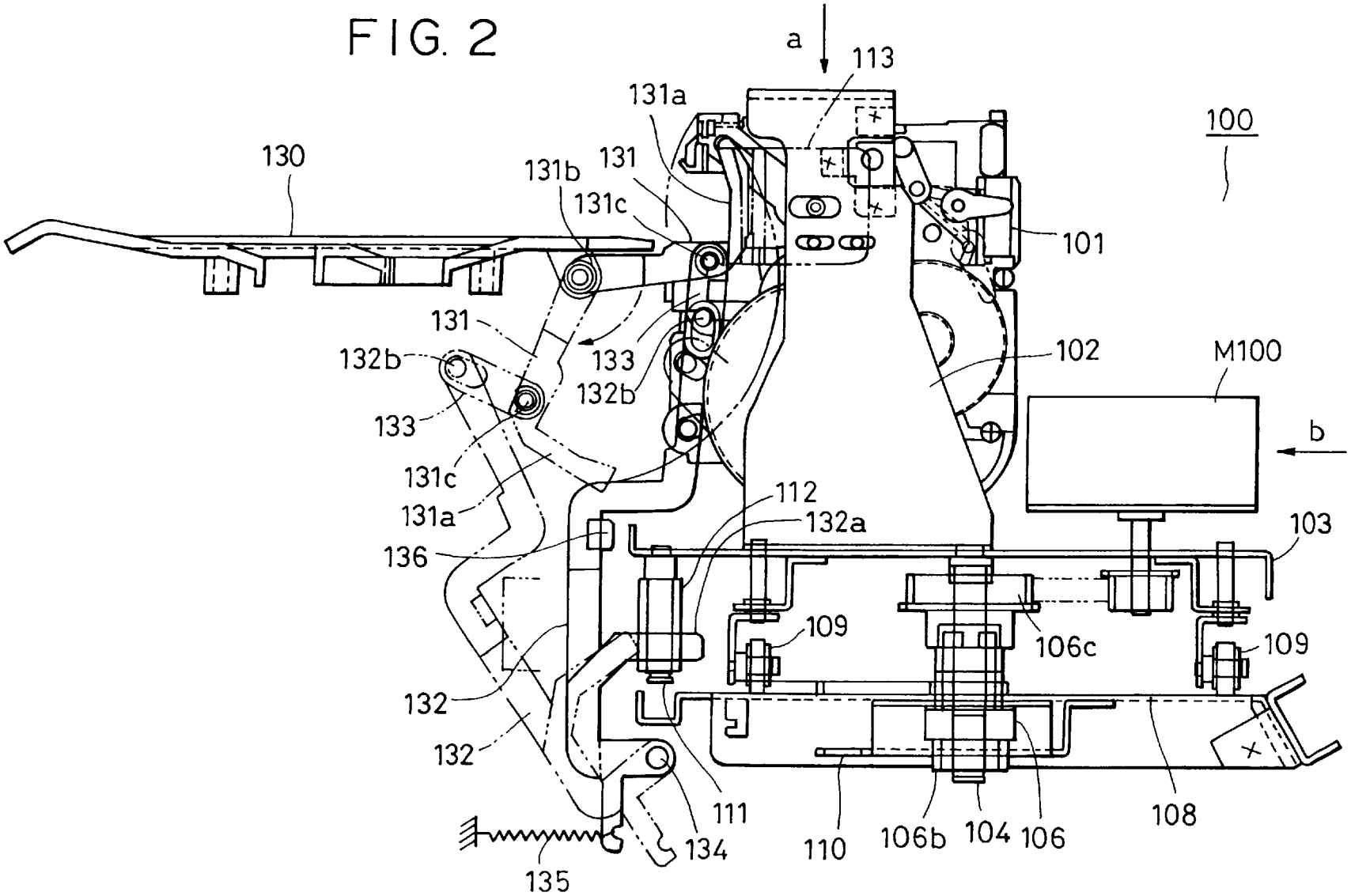
FIG. 2 is a side view of a stapling unit in the sheet handling device.

Therefore, when the movable carriage 103 moves, the stopper turning rollers 112 of the movable carriage 103 press the cam surfaces 132*a* of the main links 132, and the rear end stoppers 131, which have an interfering relationship with the stapler 101, are pivoted to a non-interference position shown by a two-dot chain line in FIG. 2. This prevents the rear end stoppers 131 from colliding with the stapler 101. After the stapling operation, which will be described later, the movable carriage 103 returns to the home position, and the rear end stoppers 131 also return to the initial state. In order for the rear end stoppers 131 to be held in the retracted position during the operation of the stapler 101, a plurality (three in this embodiment) of stopper turning rollers 112 are arranged in the moving direction of the movable carriage 103.

The holder 102 for holding the stapler 101 has, on both side faces, stapler stoppers 113 (shown by a two-dot chain line in FIG. 2) having a support surface in the shape similar to that of the abutting support surfaces 131*a* of the rear end stoppers 131. The stapler stoppers 113 allow the rear ends of the sheets to be supported even when the rear end stoppers 131 are in the retracted position.

Outline of Handling Tray Unit

Next, the handling tray unit 129 including the handling tray 130 will be described in detail with reference to FIGS. 5 and 6.

The handling tray unit 129 comprises the handling tray 130, the rear end stoppers 131, an aligning means 140, the pivoting guide 150, a pull-in paddle 160, a pair of stack ejection rollers 180, and knurl belts (feeding members like an endless belt) 190 to be rotated by the pair of first ejection rollers 7 (ejection means) composed of the election rollers 7*a* and 7*b*.

In this case, the handling tray 130 is placed in the tilting position so that the downstream side (the upper left side in FIG. 5) thereof in the stack ejecting direction is placed at the upper position, and the upstream side (the lower right side in FIG. 5) is placed at the lower position. Arranged at the lower end on the upstream side of the handling tray 130 are sheet guides 130*c* and knurl belts 190 spaced at predetermined intervals in the sheet width direction, and the above-described rear end stoppers 131. In the middle section, the aligning means 140 including the pull-in paddle 160, which will be described later, is placed corresponding to the outsides of both right and left sides of a sheet P. In the upper part on the downstream side, more specifically, in the substantially upper region of the handling tray unit 129, the pivoting guide 150 is placed to include the pull-in paddle 160 and the pair of stack ejection rollers 180.

Figure 6:
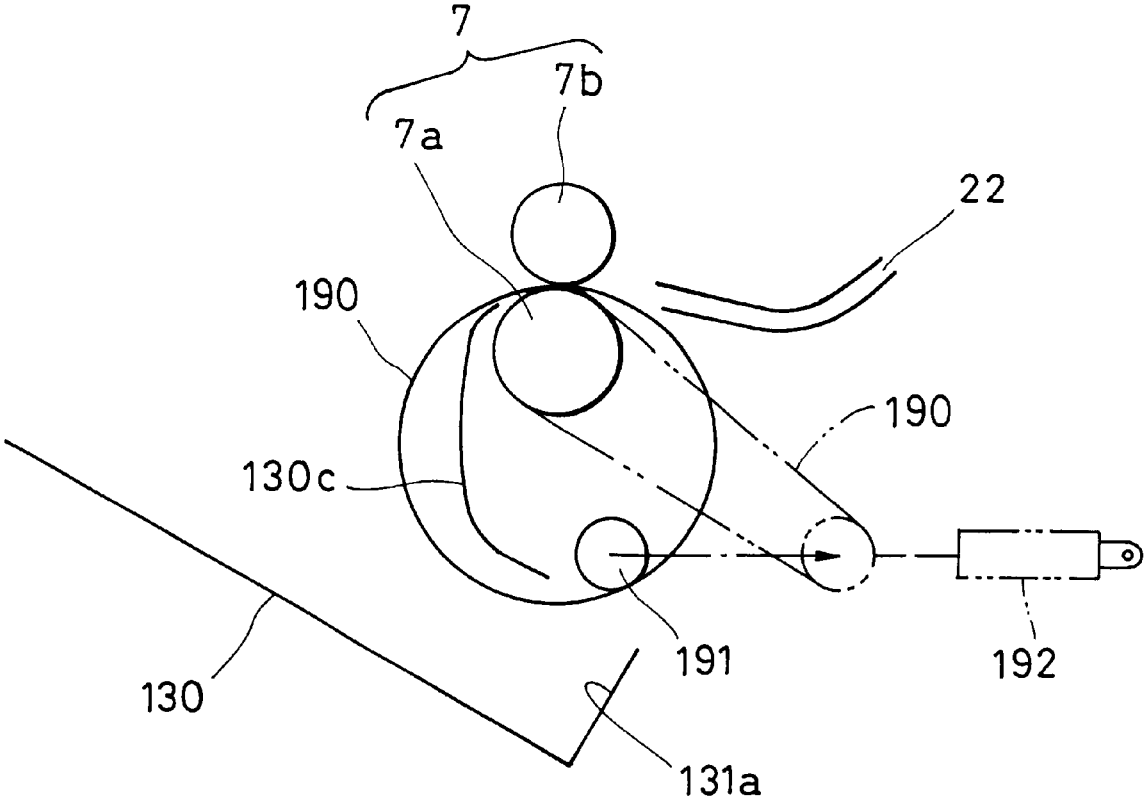
FIG. 6 is a side view of knurl belts and a belt shift mechanism.

As shown in FIG. 6, the knurl belts 190 have a required diameter, and are knurled for slip prevention over all the outer peripheral surface thereof. The knurl belts 190 are flexible such as to be deformable in the rotating direction, and are rotatably supported by being wound on the lower one of the first ejection rollers 7, i.e., the ejection roller 7*a* on the side of the handling tray 130. Furthermore, floating rollers 191 are provided to rotate in contact with the lower inner peripheral surfaces of the knurl belts 190, and are pulled to the rear side in FIG. 6, and toward the support surfaces 131*a* of the rear end stoppers 131 by a pulling actuator (traction means) 192 during a paddling operation and an aligning operation (which will be described later), in particular, at the beginning of the aligning operation subsequent to the paddling operation. The knurl belts 190 are thereby pulled to the inside of the sheet guides 130*c* discussed above, and are deformed (shown by a two-dot chain line in FIG. 6), which allows the sheets to reliably abut against the support surfaces 131*a*.

The operation of the pulling actuator 192 is controlled by a control device (control means) 310 shown in FIG. 1.

When the knurl belts 190 are not being pulled, the bottoms thereof project from the sheet guides 130*c* and are placed at a projecting position in proximity to the surface of the handling tray 130.

While the knurl belts 190 are being pulled, they are placed in the retracted position inside the sheet guides 130*c* and are not in contact with the sheets in the handling tray 130, as described above. The knurl belts 190 are usually placed in the above-described projecting position.

A sheet P ejected from the first ejection rollers 7 slides downward on the handling tray 130 along the sheet guides 130*c* until the rear end thereof knocks against the abutting support surfaces 131*a* of the rear end stoppers 131, by its own weight and by the action of the pull-in paddle 160, which will be described later, and the feeding action of the lower sides of the knurl belts 190.

The lower ejection roller 180*a* of the pair of stack ejection rollers 180 is placed at the upper end of the handling tray 130, as described above, and the upper ejection roller 180*b* is placed at the lower front end of the pivoting guide 150 so as to be in separable contact with the lower ejection roller 180*a*. These ejection rollers 180*a* and 180*b* can be rotated forward and in reverse by a driving motor M180.

Detailed Description of Aligning Means

Next, the aligning means 140 constituting a principal part of the present invention will be described in detail with reference to FIGS. 5, 6, and FIG. 7 which is a plan view seen from the direction of the arrow "c" in FIG. 5.

Figure 7:
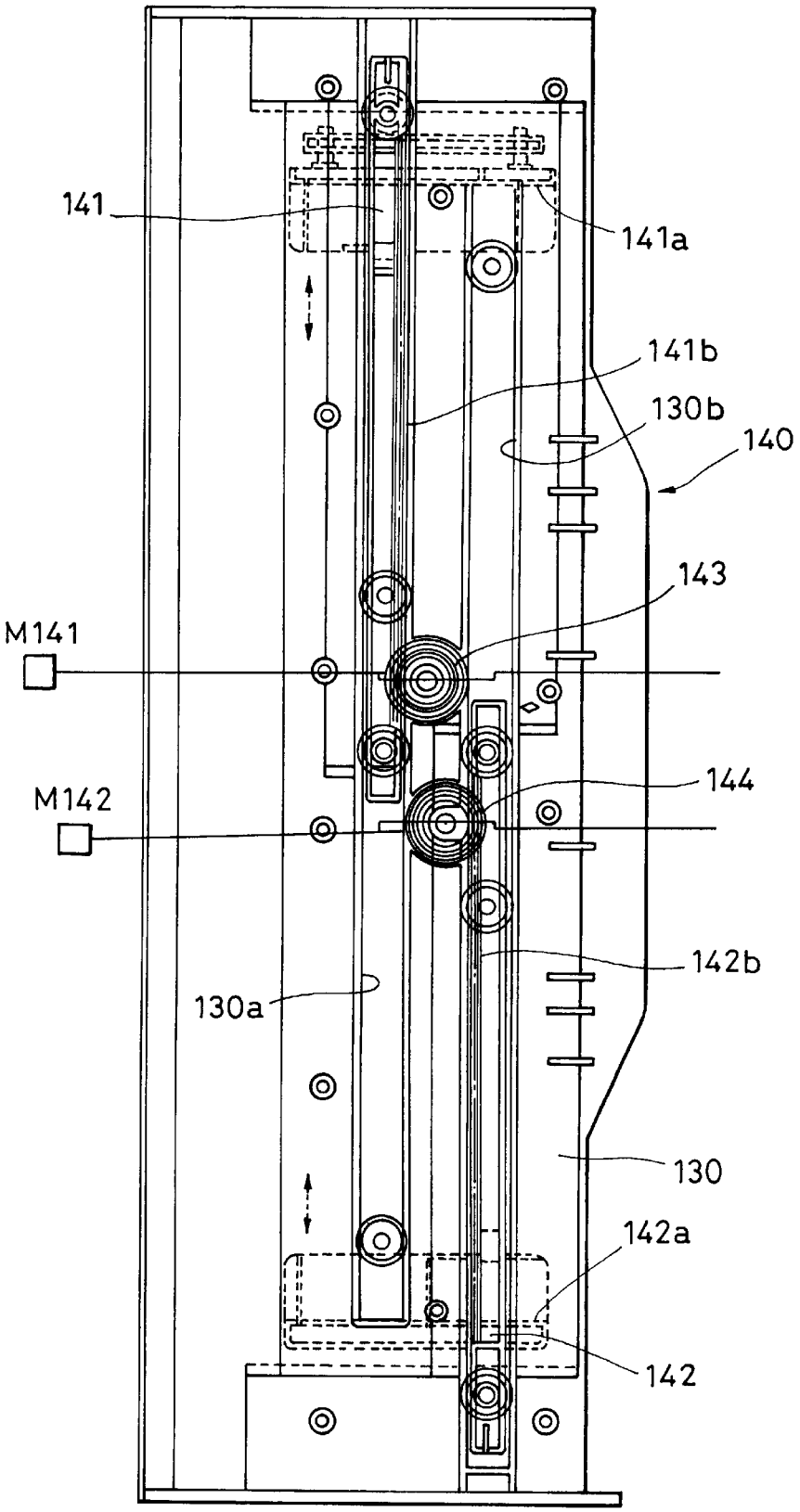
FIG. 7 is a plan view of the handling tray and an aligning member shift mechanism.

A pair of aligning members 141 and 142 constituting the aligning means 140 are separately placed opposed to each other in the handling tray 130 on the upper and lower sides of FIG. 7 (corresponding to both sides of a sheet P). The first aligning member 141 on the upper side and the second aligning member 142 on the lower side have aligning surfaces 141*a* and 142*a* perpendicular to the surface of the handling tray 130 so as to press and support the side ends of sheets P, and have rack gear portions 141*b* and 142*b* for supporting the bottom side of the sheets. The rack gear portions 141*b* and 142*b* are placed on the lower surface of the handling tray 130 through a pair of guide grooves 130*a* and 130*b* formed in the handling tray 130 in parallel with the upward and downward directions (corresponding to the sheet width direction).

In short, the first and second aligning members 141 and 142 are assembled with the handling tray 130 so that the aligning surfaces 141*a* and 142*a* are placed opposed to each other on the upper surface of the handling tray 130, and the rack gear portions 141*b* and 142*b* are placed on the lower surface so as to move in the aligning direction.

The rack gear portions 141*b* and 142*b* are meshed with pinion gears 143 and 144 that are driven forward and in reverse by driving motors M141 and M142, which allows the first and second aligning members 141 and 142 to move in the aligning direction. Position sensors (not shown) are provided to detect the home positions of the first and second aligning members 141 and 142. In normal cases, the first aligning member 141 stands by at the home position set at the upper end in FIG. 7, and the second aligning member 142 stands by at the home position set at the lower end.

Detailed Description of Pivoting Guide

Next, the pivoting guide 150 will be described in detail.

The pivoting guide 150 pivotally supports, at the front end on the lower side corresponding to the downstream side (the left side in FIG. 5), the upper ejection roller 180*b* of the pair of stack ejection rollers 180 to be in separable contact with the lower ejection roller 180*a*. The pivoting guide 150 is pivotally supported by a support shaft 151 at the rear end on the lower surface corresponding to the upstream side (the right side in FIG. 5), and is pivoted by the driving of a rotation cam 152 by a driving motor M150. The pivoting guide 150 at the home position is in a closed state so that the upper ejection roller 180*b* is in contact with the lower ejection roller 180*a*. A position sensor (not shown) is provided to detect the home position.

In normal cases, when sheets are ejected into the handling tray 130, the pivoting guide 150 shifts to an open state (pivots upward to separate the upper ejection roller 180*b* from the lower ejection roller 180*a*), thereby allowing the operations of ejecting and aligning the sheets, and the operation of the pull-in paddle 160, which will be described later, to be performed without any trouble. In ejecting a stack of sheets in the handling tray 130 into the stack tray 200, the pivoting guide 150 shifts to the closed state (pivots downward to put the upper ejection roller 180*b* into contact with the lower ejection roller 180*a*).

Detailed Description of Pull-In Paddle

Next, the pull-in paddle 160 will be described in detail.

Figure 5:
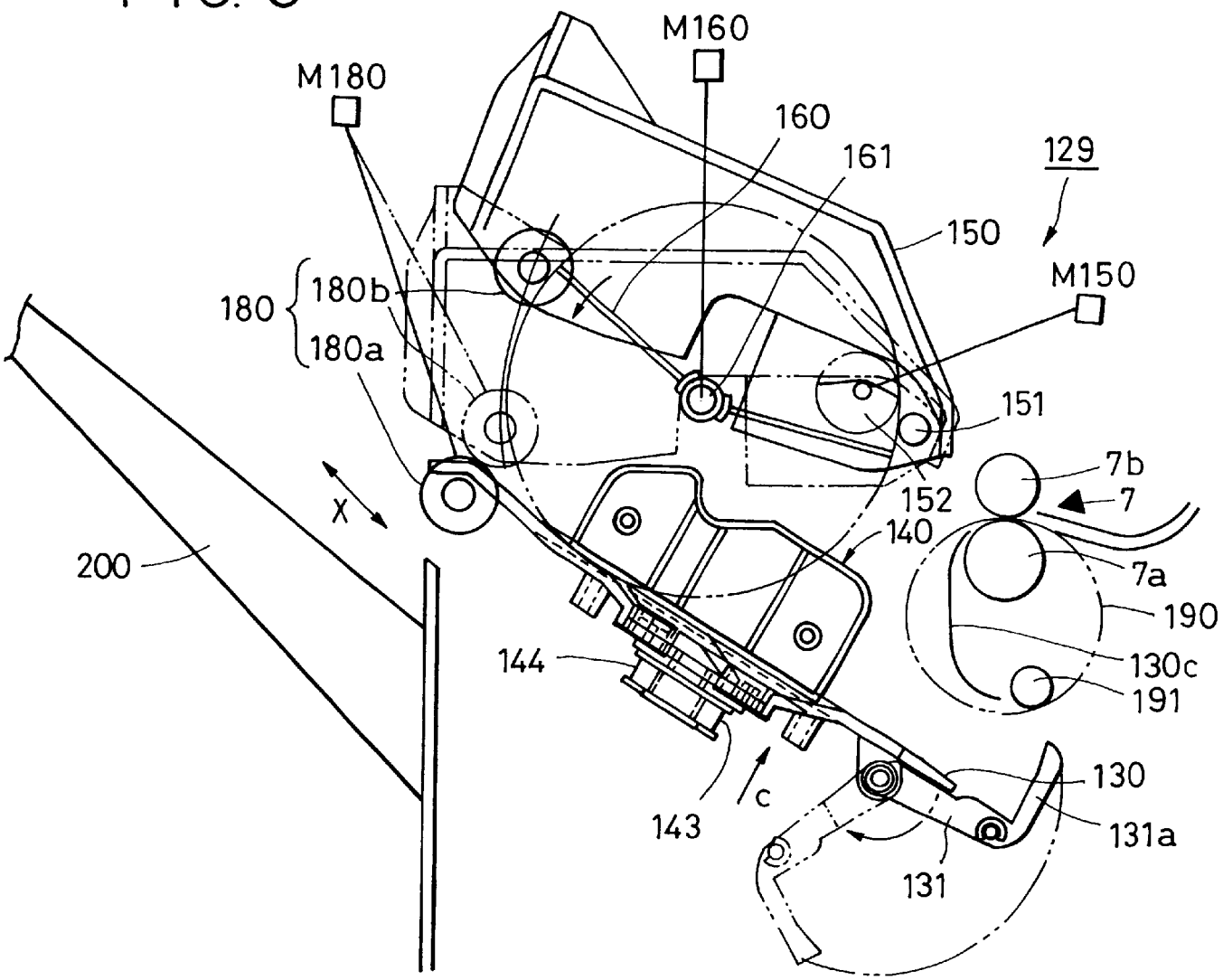
FIG. 5 is a longitudinal sectional side view of a pivoting guide and a handling tray.

The pull-in paddle 160 is fixed to a driving shaft 161 above the handling tray 130 and is rotated at appropriate timing by a driving motor M160 in the counterclockwise direction in FIG. 5. The length of the paddle portions in the pull-in paddle 160 is set to be somewhat greater than the distance to the surface of the handling tray 130, and the home position thereof (shown by a solid line in FIG. 5) is set so as not to interfere with the ejection of sheets from the first ejection rollers 7 into the handling tray 130.

When sheets are ejected into the handling tray 130 in this state, the pull-in paddle 160 is rotated counterclockwise to pull the sheets inside so that the rear ends of the sheets knock against the abutting support surfaces 131*a* of the rear end stoppers 131. After a predetermined time has passed, the pull-in paddle 160 stops at the appropriate time at the above-described home position so as to be detected by a position sensor (not shown).

Detailed Description of Stack Tray and Sample Tray

Figure 8:
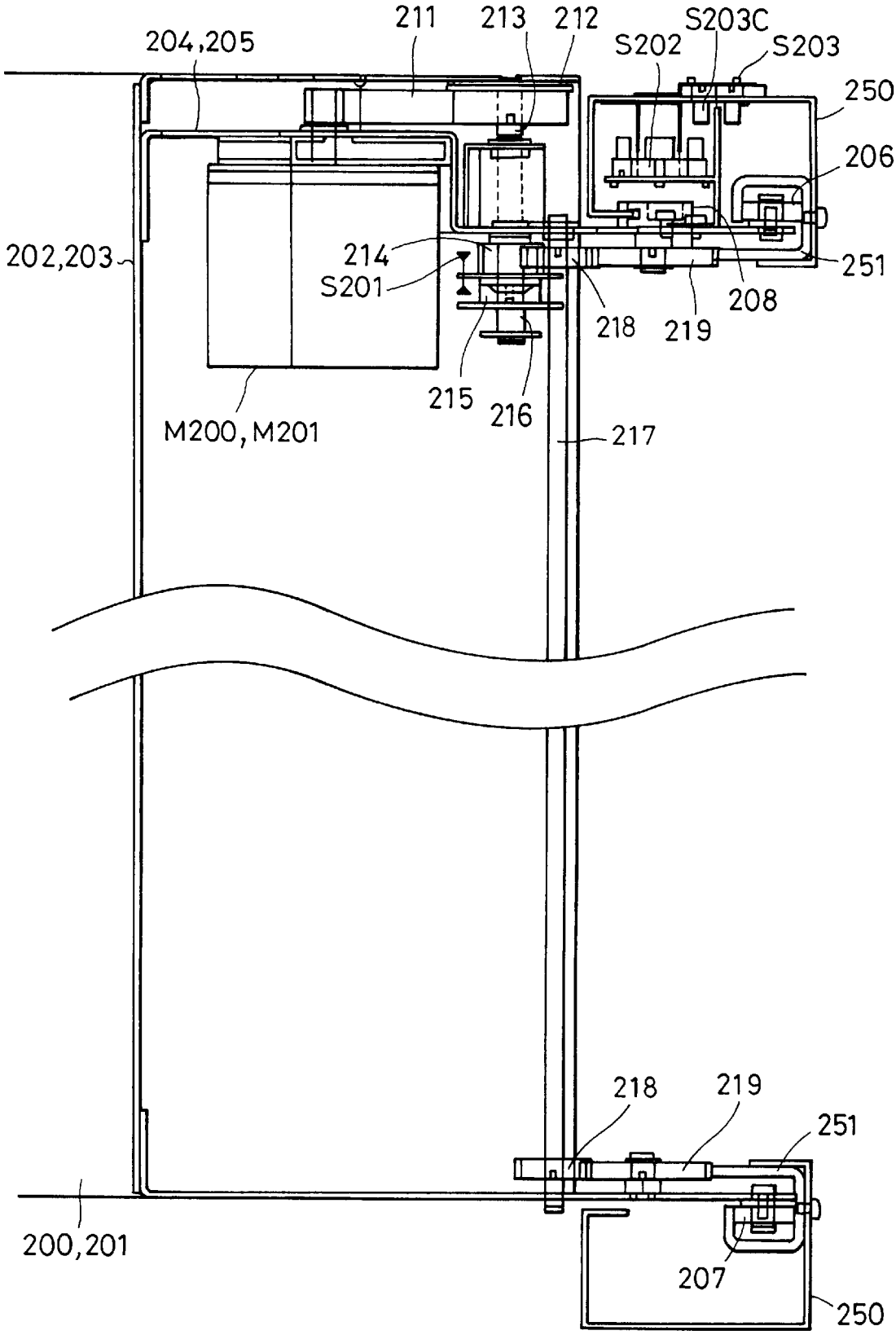
FIG. 8 is a plan view of a stack tray shift mechanism.
Figure 9:
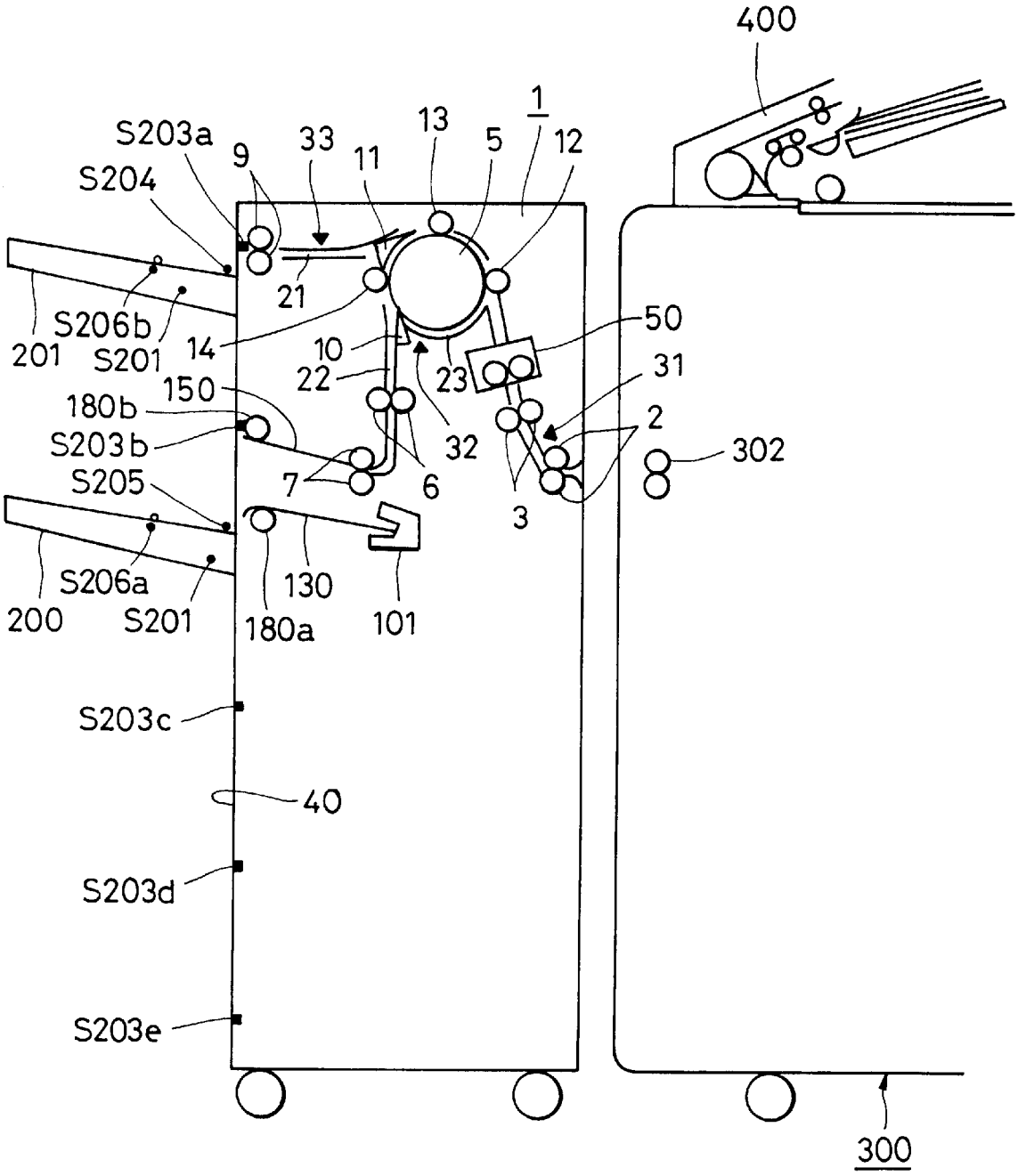
FIG. 9 is a layout view of sensors placed in the neighborhood of the stack tray.
Figure 10:
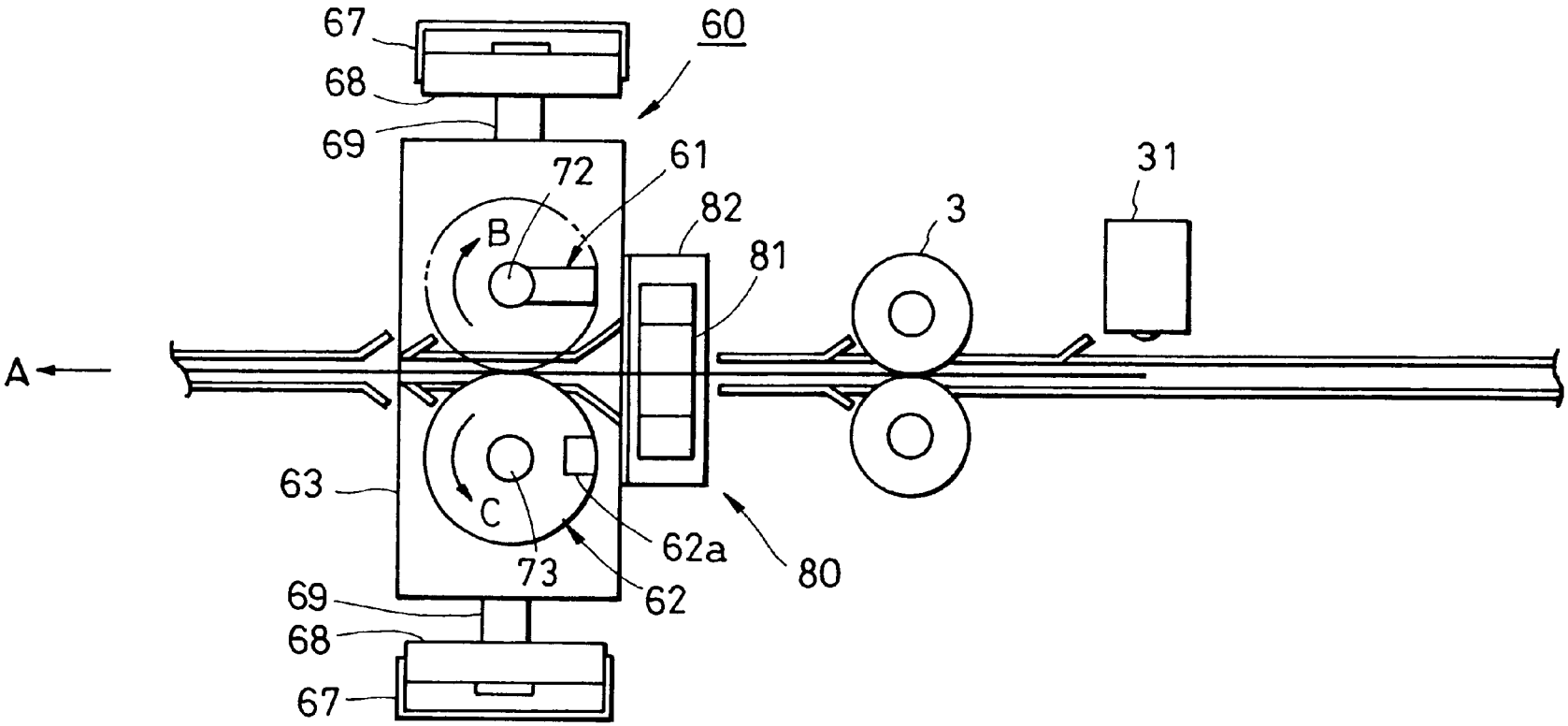
FIG. 10 is a side view of a punching unit.
Figure 11:
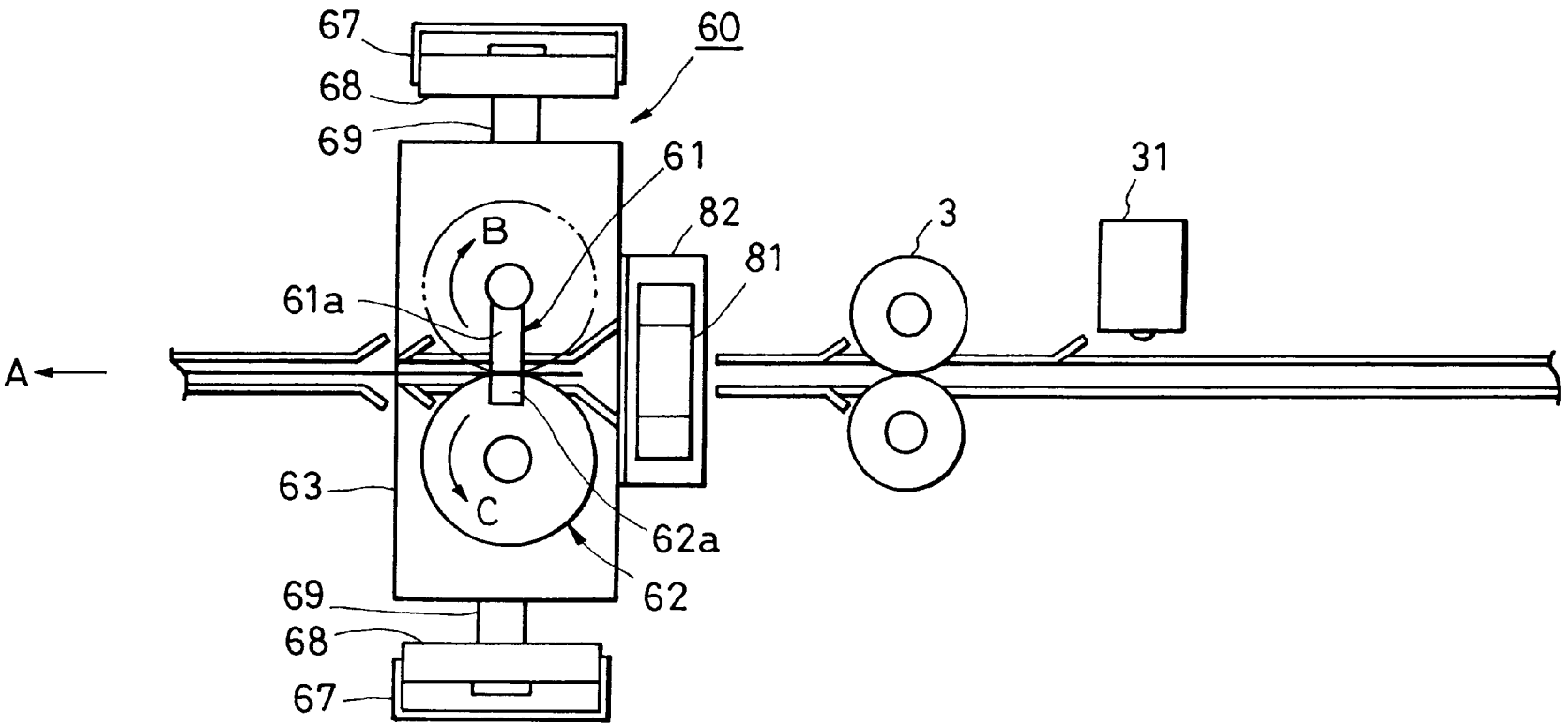
FIG. 11 is a side view showing an operational state of the punching unit.
Figure 12:
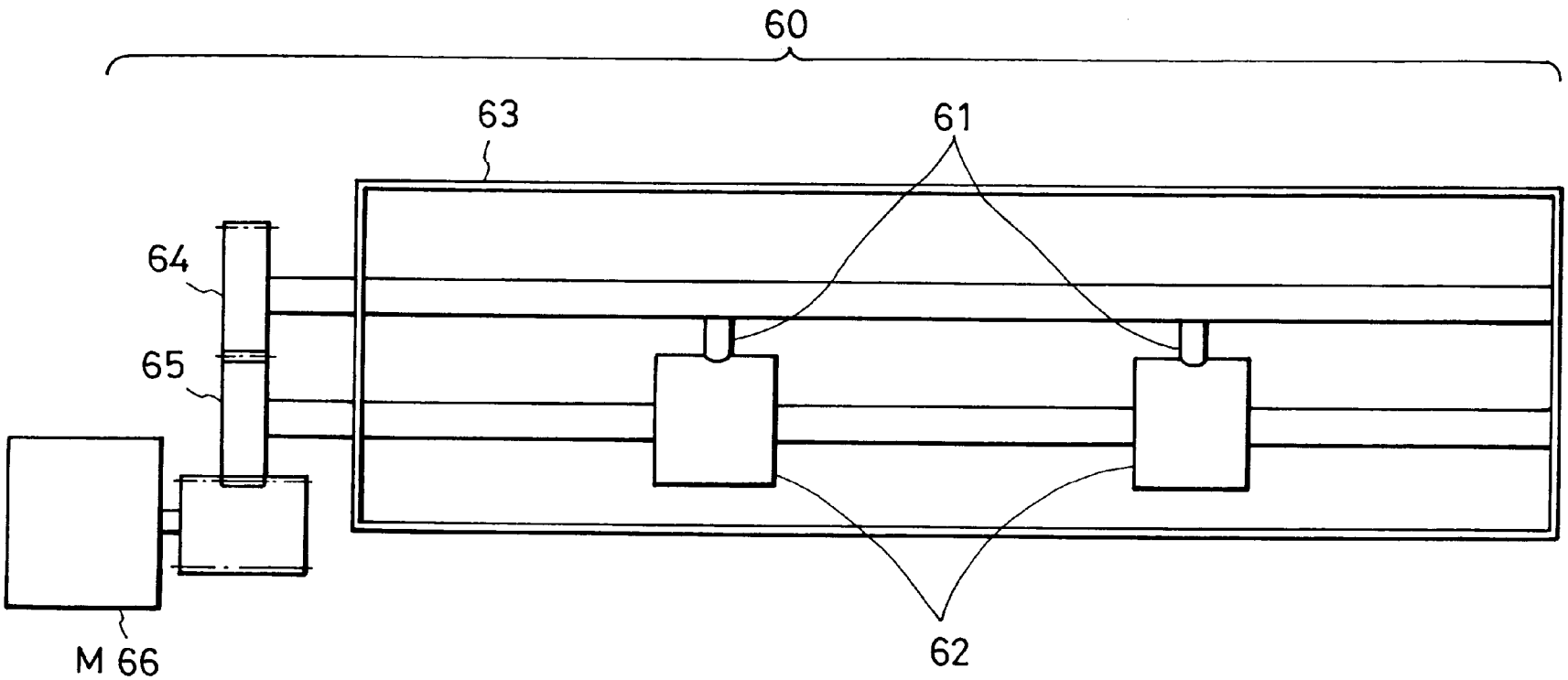
FIG. 12 is a plan view of the punching unit.

Next, the stack tray 200 and the sample tray 201 will be described in detail with reference to FIGS. 8 and 9.

The stack tray 200 and the sample tray 201 are switched according to the requirements. The stack tray 200 disposed at the lower position is selected to receive a stack of sheets for copy output, printer output, and the like, and the sample tray 201 disposed at the upper position is selected to receive sheets for sample output, interrupt output, output at the overflow of the stack tray 200, function output, output in a consolidated job, and the like.

The stack tray 200 and the sample tray 201 are held by tray base plates 202 and 203, and are independently moved up and down by using stepping motors M200 and M201 fixed to the base plates 202 and 203 via attachment frame plates 204 and 205. Since both the trays 200 and 201 have a substantially similar structure in this case, description will be given only of the stack tray 200.

That is, a pair of frames 250 are vertically provided at both ends of the sheet handling device 1, and rack gear members 251 serving as vertical guide rail portions are mounted thereon. A pair of guide rollers 206 and 207 are rotatably mounted at the rear end portion extending from one side of the tray base plate 202 (corresponding to the left side with reference to the sheet width direction) and at the rear end portion extending from the attachment frame plate 204 opposed thereto (similarly corresponding to the right side), and are fitted in the corresponding guide rail portions, whereby the stack tray 200 is held to move up and down. Moreover, a regulating member 208 is engaged with the folded end of one of the frames 250, thereby restraining rattling in the sheet width direction.

Furthermore, the rotation output of the stepping motor M200 is transmitted to a pulley 212 of a driving shaft 213 via a timing belt 211. The driving shaft 213 is provided with a ratchet wheel 215 that is urged by a spring 216 and is allowed only to slide in the axial direction. The ratchet wheel 215 is in one-direction engagement with a driving gear 214 on the driving shaft 213. The driving gear 214 is meshed with one of the idler gears 218 disposed at both ends of a driven shaft 217, and the idler gears 218 are engaged with the rack gear members 251 via lifting gears 219. That is, the stack tray 200 is vertically moved via the driving system composed of this train of gears.

The ratchet wheel 215 in one-direction engagement with the driving gear 214 on the driving shaft 213 is provided to prevent the driving system from being damaged, for example, if foreign materials or the like are caught in the driving system during the downward movement of the stack tray 200. In this embodiment, the spring 216 is given the required urging force, and the ratchet wheel 215 is idly turned against the urging force of the spring 216 on the preset conditions only when the stack tray 200 is moved up. During such idle turning, that is, when abnormal conditions are encountered, a clock slit or the like formed in a flange portion of the idler gear 218 is detected by a sensor S201 so as to immediately stop the drive of the stepping motor M200. The sensor S201 is also used to detect the out-of-step state in a normal operation. Numeral S203 in FIG. 8 also denotes a sensor.

Next, description will be given of the layout of sensors for controlling the vertical positions of the stack tray 200 and the sample tray 201.

A sensor S202 for detecting a stacking area of the sample tray 201 detects sheets being placed within the area from an upper limit position detection sensor S203*a* of the sample tray 201 to a handling tray sheet surface detection sensor S205.

A sensor S203*b* serves to detect the number of sheets ejected from the second ejection rollers 9 into the sample tray 201 reaching a predetermined number, and in this embodiment, is placed at a height corresponding to a thousand stacked sheets from a non-sort sheet surface detection sensor S204.

A sensor S203*c* serves to sense that the number of sheets ejected from the handling tray 130 into the sample tray 201 reaches a predetermined number, and is similarly placed at a distance corresponding to a thousand stacked sheets from the sheet surface detection sensor S205.

A sensor S203*d* serves to limit the height of stacked sheets which the stack tray 200 receives from the handling tray 130, and is placed at a distance corresponding to two thousand stacked sheets from the sheet surface detection sensor S205.

A sensor S203*e* serves to set the lower limit position of the stack tray 200.

Furthermore, the stack tray 200 and the sample tray 201 are provided with sheet detection sensors 206*a* and 206*b*.

Only the sheet surface detection sensors S204 and S205 of these sensors are set to be of a light transmissive type in which the presence of a sheet is detected by light transmission from one side to the other side. In order to detect the sheet surface, the trays 200 and 201 are initially moved up from below the sheet surface detection sensors S204 and S205 to the positions where they cover the sheet surface detection sensors S204 and S205, are moved down after sheet stacking until the optical axis of the sensor appears, and are moved up again to cover the sensor optical axis. These operations are then repeated.

Detailed Description of Punching Unit

Next, the punching unit 50 will be described in detail with reference to FIGS. 10 to 14.

The punching unit 50 is composed of a punching means 60 and a lateral registration detecting means 80.

In the punching means 60, a required number of pairs of right and left punching members 61, and dicing members 62 to be combined with the punching members 61 are placed at a predetermined punching interval in the right and left direction (corresponding to the sheet width direction) inside a casing 63. Interlocking gears 64 and 65 on the shafts thereof are meshed with each other, and are rotated by the driving of a punching motor M66 in synchronization in the directions of the arrows B and C in FIGS. 10 and 11. In normal states, the interlocking gears 64 and 65 stand by at the home position shown in FIG. 12.

After the sheet detection sensor 31 (see FIGS. 1, 13, and 14) detects the rear end of an introduced sheet in this state, the punching motor M66 is driven in a predetermined timing, whereby punching projections of the punching members 61 are engaged with dicing holes 62*a* of the dicing members 62 to form intended punching holes in corresponding portions of the sheet. In this case, punching can be performed simultaneously during feeding by setting the rotation speed of the punching members 61 and the dicing members 62 to be the same as the rotation speed of the feeding rollers 3 (see FIG. 1) and the feeding speed of the sheet in the direction of the arrow A in FIGS. 10 and 11.

Figure 13:
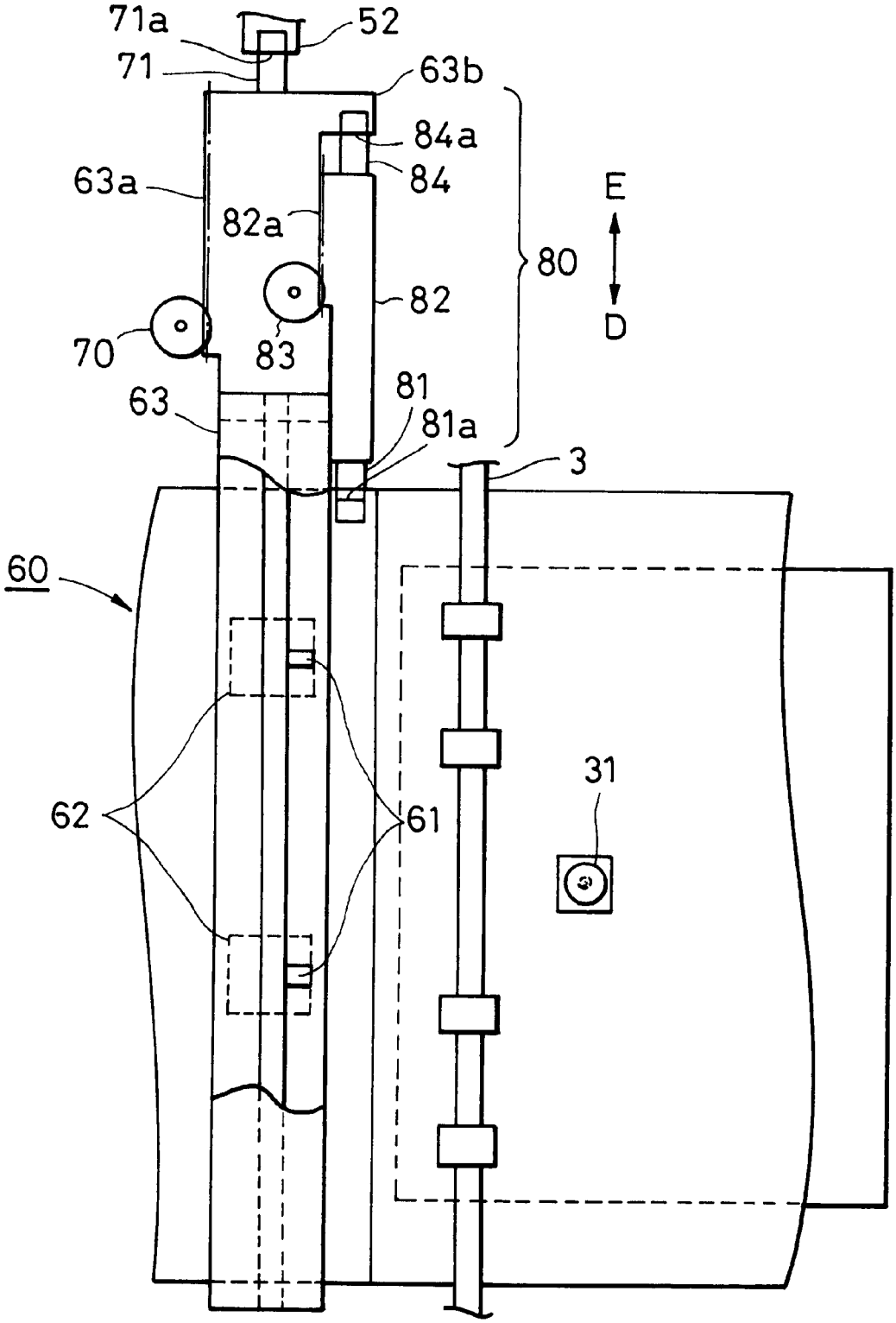
FIGS. 13 and 14 are explanatory views of a lateral registration sensor shift mechanism in the punching unit.
Figure 14:
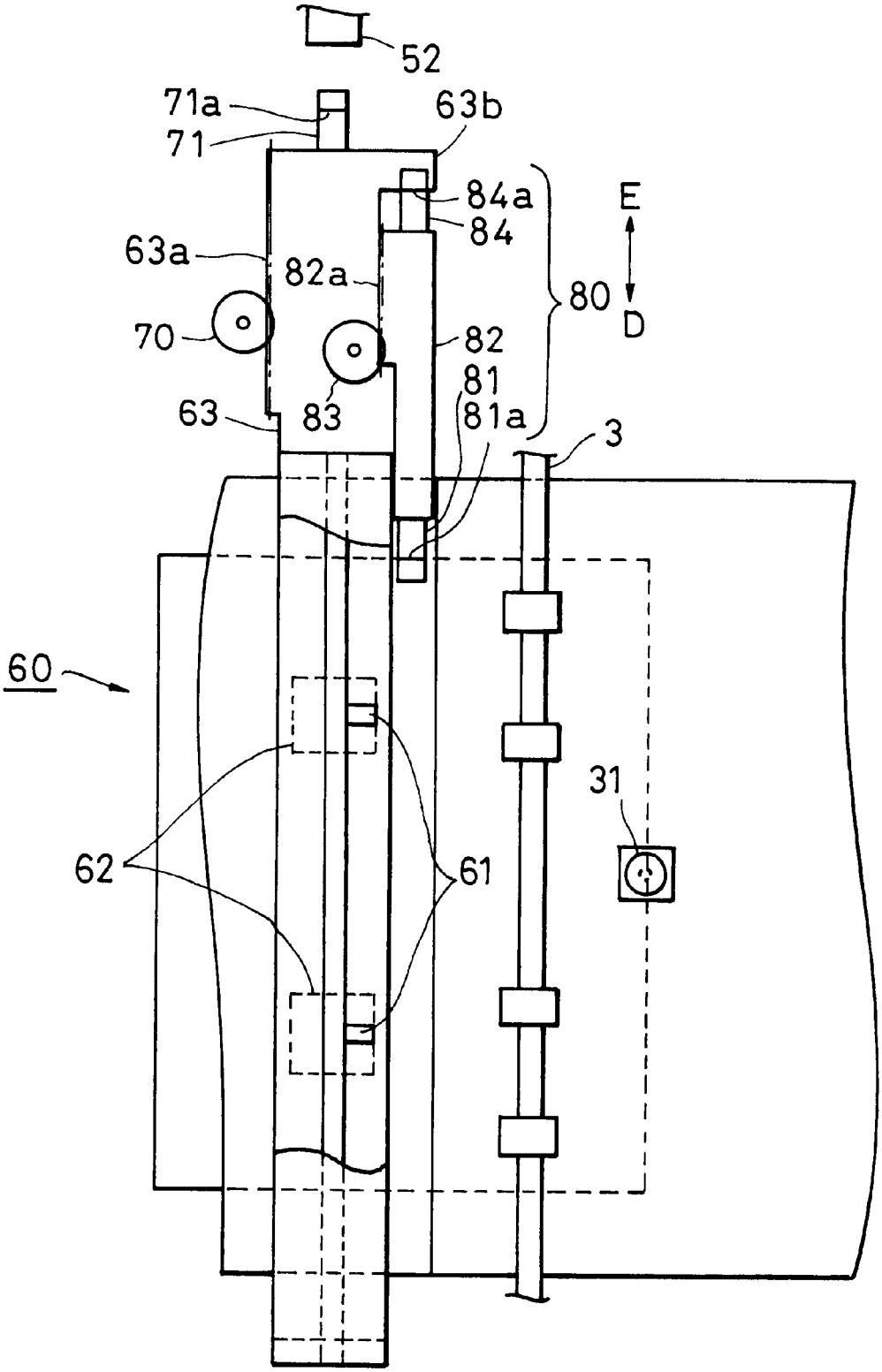

Furthermore, the punching casing 63 for holding the punching members 61 and the dicing members 62 is provided with guide rollers 68 vertically arranged and rotatably supported by support shafts 69, and is allowed to move in the sheet width direction by fitting the guide rollers 68 in guide rails 67 in parallel with the sheet width direction. As shown in FIGS. 13 and 14, a pinion gear 70 to be rotated by a punching means shift motor (not shown) is meshed with a rack gear 63*a* formed at one side end of the casing 63, and a punching means initial position detection sensor 71 is disposed having a light receiving portion 71*a* on the end face thereof.

For this reason, the punching means 60 is moved in the directions of the arrows D and E orthogonal to the sheet feeding direction A by the driving of the punching means shift motor. With this movement, a punching means initial position setting portion 52 formed on the main body of the device is detected by the punching means initial position detection sensor 71. In this case, the punching means initial position is set several millimeters before the sheet reference position corresponding to the amount of skewing of the sheet and offset in lateral registration.

The lateral registration detection means 80 has, on one side of the punching means 60, a sensor arm 82 that is similarly moved in the directions of the arrows D and E (the sheet width direction) orthogonal to the sheet feeding direction A by meshing a pinion gear 83, which is rotated by a lateral registration shift motor (not shown), with a rack gear 82*a* at the side edge. At one end of the sensor arm 82 close to the sheet P, a lateral registration sensor 81 is provided to move in the directions of the arrows D and E (sheet width direction) orthogonal to the sheet feeding direction A. The lateral registration sensor 81 has a light receiving portion 81*a* for detecting one side edge of the sheet P. At the other end of the sensor arm 82, a lateral registration initial position sensor 84 is provided which has a light receiving portion 84*a* in parallel with the light receiving portion 81*a*.

For this reason, the lateral registration detection means 80 is moved in the directions of the arrows D and E orthogonal to the sheet feeding direction A by the driving of the lateral registration shift motor, in a manner similar to the above-described punching means 60. With this movement, a lateral registration position setting portion 63*b* on the end face of the punching casing 63 is detected by the lateral registration initial position detection sensor 84. In this case, the lateral registration sensor 81 can be set at a position corresponding to the selected sheet size.

In detecting the side edge of a sheet, the leading end of the sheet is detected by the sheet detection sensor 31, and the punching means shift motor is driven at a predetermined timing to move the punching means 60 and the lateral registration sensor 81. The punching means 60 and the lateral registration sensor 81 are stopped when the light receiving portion 81*a* of the lateral registration sensor 81 is blocked by the side edge of the sheet and thereby detects the side edge. That is, the punching position of the sheet is thereby allowed to be set at the end of the sheet.

Next, description will be given of the travel of sheets in the sheet handling device 1.

Travel of Sheets in Non-Sort Mode

Figure 15:
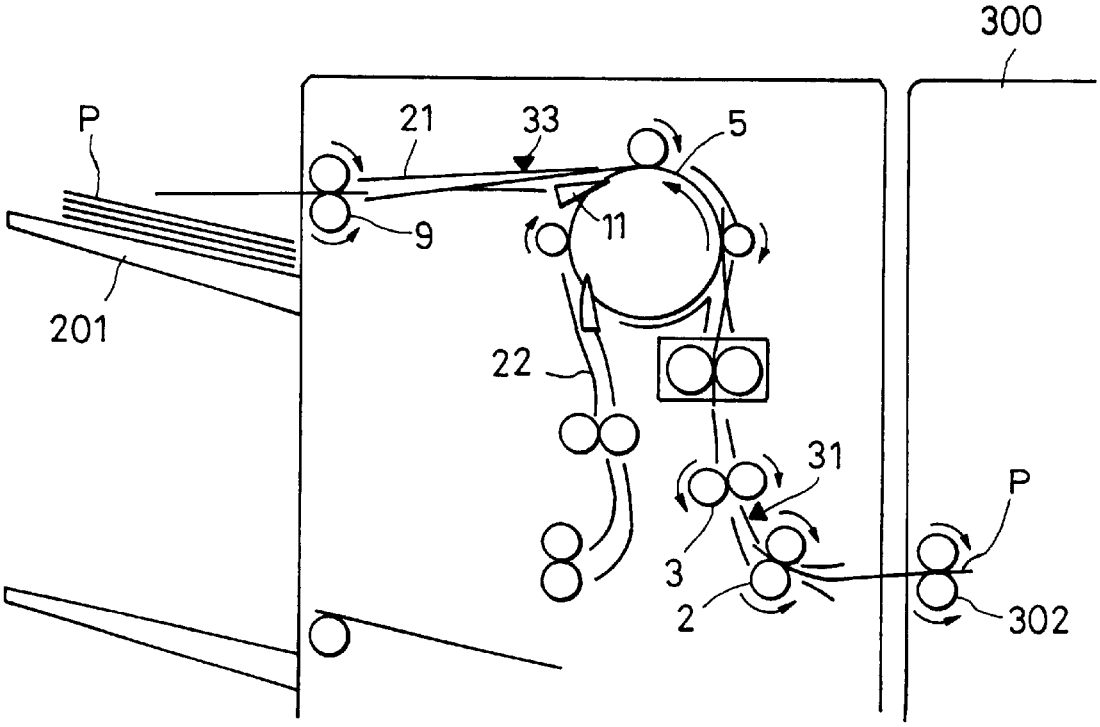
FIG. 15 is an operational view of the sheet handling device in a non-sort mode.

When a user selects a non-sort mode from among the ejection modes of the image forming apparatus 300, the first switch flapper 11 of the sheet handling device 1 is switched so that a sheet P is received into the non-sort path 21, as shown in FIG. 15. In this state, the input rollers 2, the first feeding rollers 3, and the buffer roller 5 are rotated to take the sheet P ejected from the image forming apparatus 300 into the sheet handling device 1 and to convey the sheet P toward the non-sort path 21. When the rear end of the sheet P is detected by the non-sort path sensor 33, the second ejection rollers 9 are rotated at a speed suited for stacking to eject and place the sheet P into the sample tray 201.

Travel of Sheets in Staple-and-Sort Mode

Figure 16:
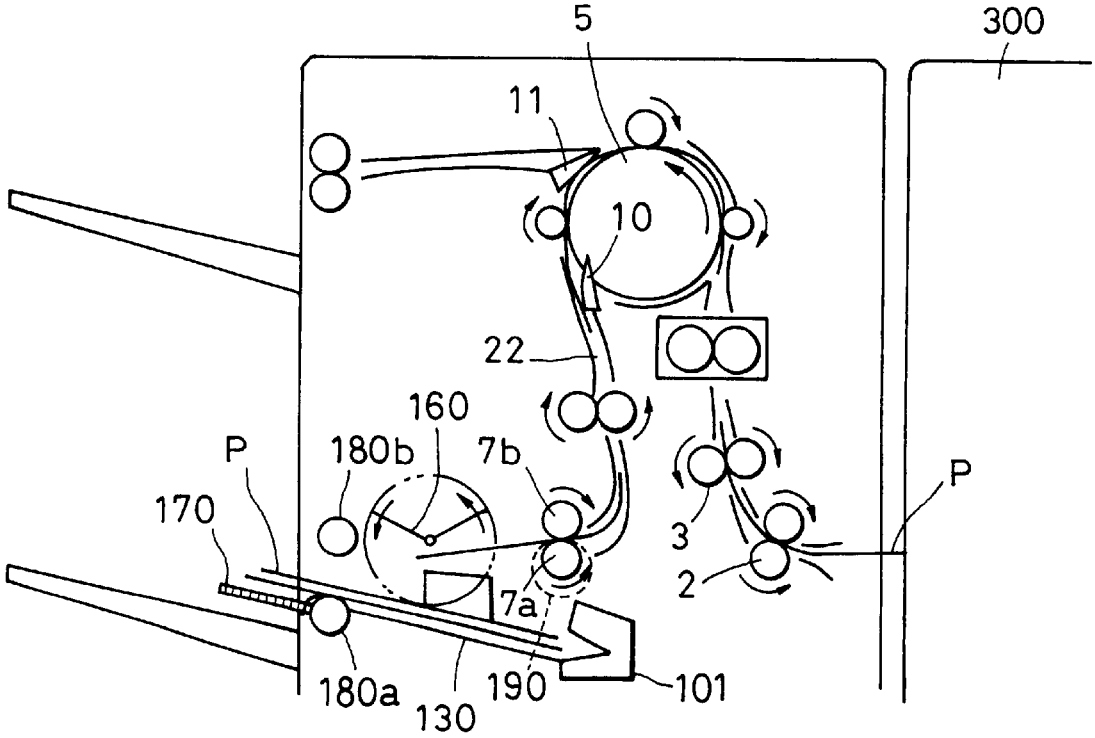
FIG. 16 is an operational view of the sheet handling device in a staple-and-sort mode.

When the user selects a staple-and-sort mode from among the ejection modes of the printer section 300 of the image forming apparatus, the first switch flapper 11 and the second switch flapper 10 in the sheet handling device 1 are switched so that a sheet P is received into the sort path 22, as shown in FIG. 16. In this state, the input rollers 2, the first feeding rollers 3, and the buffer roller 5 are rotated to take the sheet P ejected from the printer section 300 of the image forming apparatus into the sheet handling device 1 and to convey the sheet P toward the sort path 22. The sheet P is ejected into the handling tray 130 by the knurl belts 190 on the ejection rollers 7*a* in the pair of first ejection rollers 7 and the roller 7*b*. In this case, the pivoting guide 150 (not shown) is opened up, the upper ejection roller 180*b* is thereby separated from the lower ejection roller 180*a* in the stack ejection rollers 180, and a retractable tray 170 is projected in the projecting position. Therefore, even when the sheets P are ejected into the handling tray 130 by the first ejection rollers 7, they are prevented from hanging down at the leading end thereof. Moreover, return failure (which will be described later) and the like do not occur. This improves the manner in which the sheets are aligned in the handling tray 130.

Figure 17A:
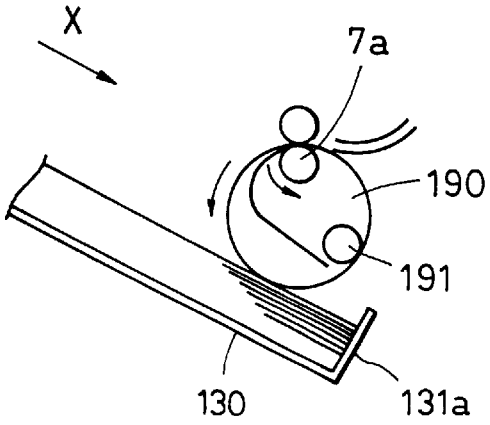
FIGS. 17A and 17B are front and side views showing the operation of knurl belts.
Figure 17B:
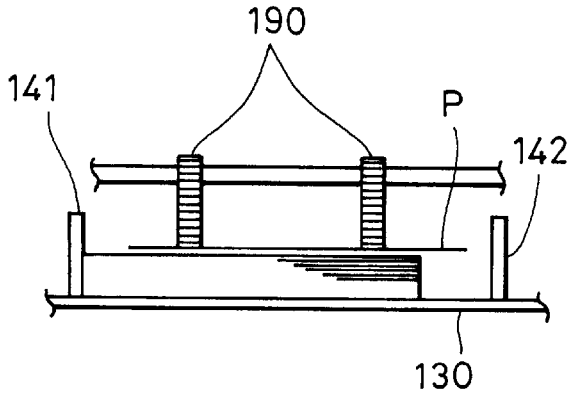

The sheet P ejected in the handling tray 130 starts to return toward the rear end stoppers 131*a* (not shown) by its own weight. Furthermore, the returning action is promoted by the counterclockwise rotation of the paddle 160 that has been stopped at the home position, and the pulling force of the knurl belts 190 rotating in the same direction as that of the ejection roller 7*a* that rotates in the ejecting direction (counterclockwise). When the rear end of the sheet P impacts the rear end stoppers 131*a*, the rotation of the paddle 160 is stopped. Since the ejection roller 7*a* continues its rotation until the end of the job, the knurl belts 190 rotate in the pulling direction during the time while pressing the rear end of the sheet P against the rear end stoppers 131*a*, as shown in FIG. 17A, thereby maintaining aligning ability.

Figure 18A:
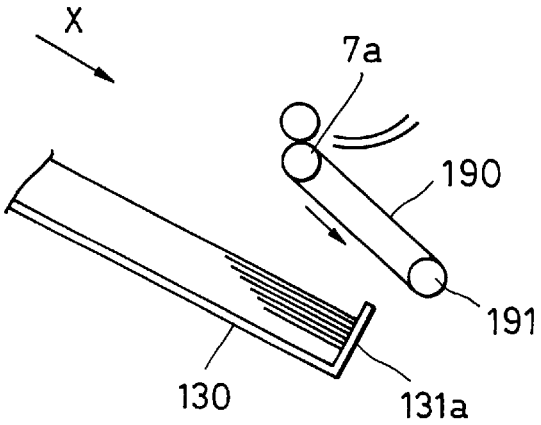
FIGS. 18A and 18B are front and side views showing a retracting operation of the knurl belts.

Subsequently, one of the aligning members 141 and 142 is moved (forward motion) to push the sheets to the aligning position in the direction orthogonal to the sheet feeding direction (pulling direction). The motion of the aligning members 141 and 142 will be described later in detail. In this case, the knurl belts 190, which have applied the pulling force to the sheets at the normal projecting position (FIG. 17A), are moved to the retracted position (the position shown by a two-dot chain line in FIG. 6) by the pulling actuator 192 in connection with the forward motion of the aligning member 141 (142), as shown in FIG. 18A. Therefore, the knurl belts 190 do not make contact with the sheets moving in the aligning direction.

Figure 18B:
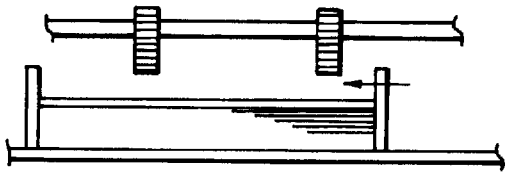

Accordingly, when the knurl belts 190 are placed in the projecting position, the sliding resistance produced in the movement of the sheets in the aligning direction is increased by the contact pressure of the knurl belts 190 in proportion to the number of sheets (thickness). In actuality, the knurl belts 190 are shifted to the retracted position, as described above, and do not impose any load on the sheets moved for alignment, which allows the sheets to be smoothly moved to the aligning position (FIG. 18B).

When the aligning member 141 (142) completes the forward motion, it is moved again to the retracted position (reverse motion). At this time, the knurl belts 190 are moved to the projecting position to contact the sheet rear ends with the rear end stoppers 131*a*, thereby maintaining aligning ability. After the above operations are repeated to the last sheet in the stack of sheets, the stack is fastened by the stapling operation of the stapler 100, is ejected by the stack ejection rollers 180 while the pivoting guide 150 is closed, and is placed into the stack tray 200.

While the knurl belts 190 are pulled by the pulling means in the retracted position so as not to be in contact with the sheets in the handling tray 130 in the above description, the knurl belts in the retracted position may be in contact with the sheets applying only a small pressure thereto so as not to impose a load on the aligning motion. In this case, since it is possible to continuously apply the pressing force toward the stoppers to the sheets during the aligning motion of the aligning member 141, sheet aligning ability is improved.

Furthermore, while the knurl belts 190 are retracted from all the sheets ejected one by one into the handling tray 130 in synchronization with the alignment of the sheets in the above description, they may be retracted when the number of sheets ejected in the handling tray 130 exceeds a predetermined number.

That is, when the thickness of the sheets stacked in the handling tray 130 is so small that the uppermost sheet is not in contact with the knurl belts 190 in the projecting position, the knurls 190 are always held in the projecting direction even during the reciprocal movement for alignment. The number of sheets stacked in the handling tray 130 is counted by the sheet detection sensor (counting means) 31 shown in FIG. 1. When the number of sheets exceeds a predetermined number, above which the uppermost sheet makes contact with the knurl belts 190, the knurl belts 190 are retracted in connection with the forward motion of the aligning member 141 for alignment.

The predetermined number of stacked sheets is preset in consideration of the amount of curl of the ejected sheets, the clearance between the knurl belts 190 and the handling tray 130, and the like. Since this reduces the number of times the knurl belts 190 retract, it is possible to improve durability of the knurl belts 190 and to reduce the working noise. The motion of the pulling actuator 192 for retracting the knurl belts 190 is controlled by the control device 310.

Figure 19:
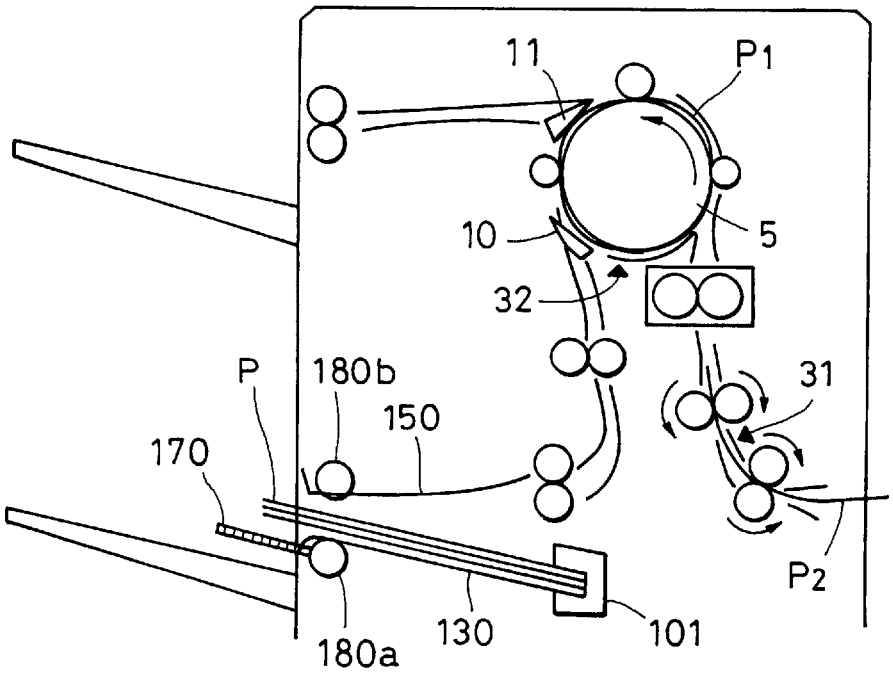
FIGS. 19 to 23 are operational views of the sheet handling device in a staple mode.
Figure 20:
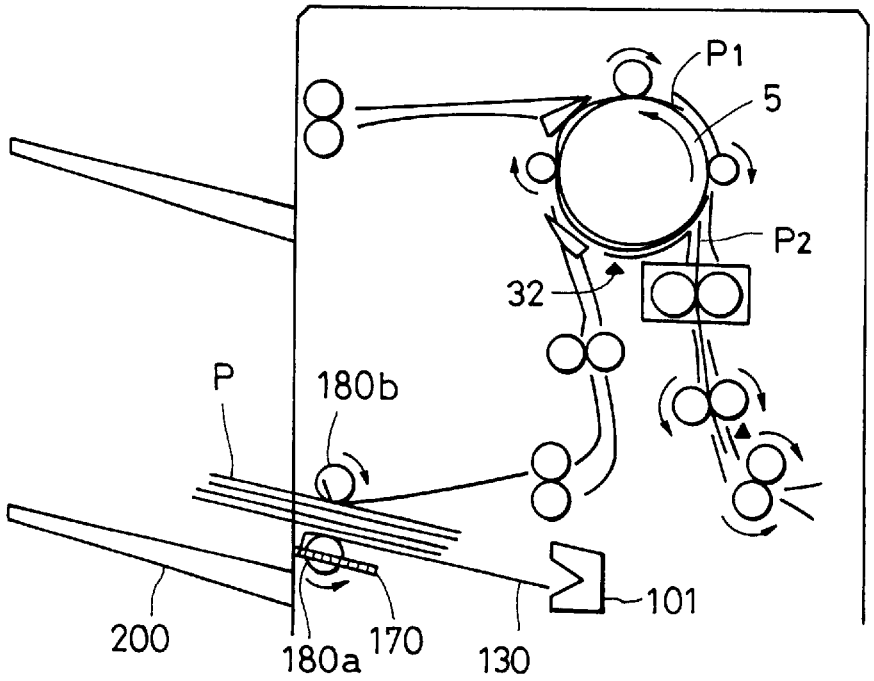
Figure 21:
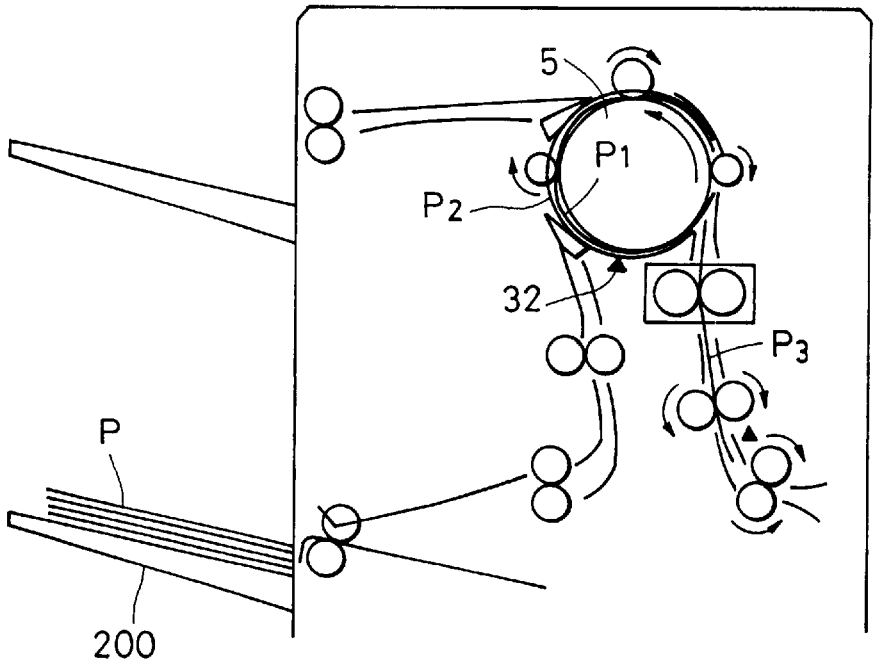
Figure 22:
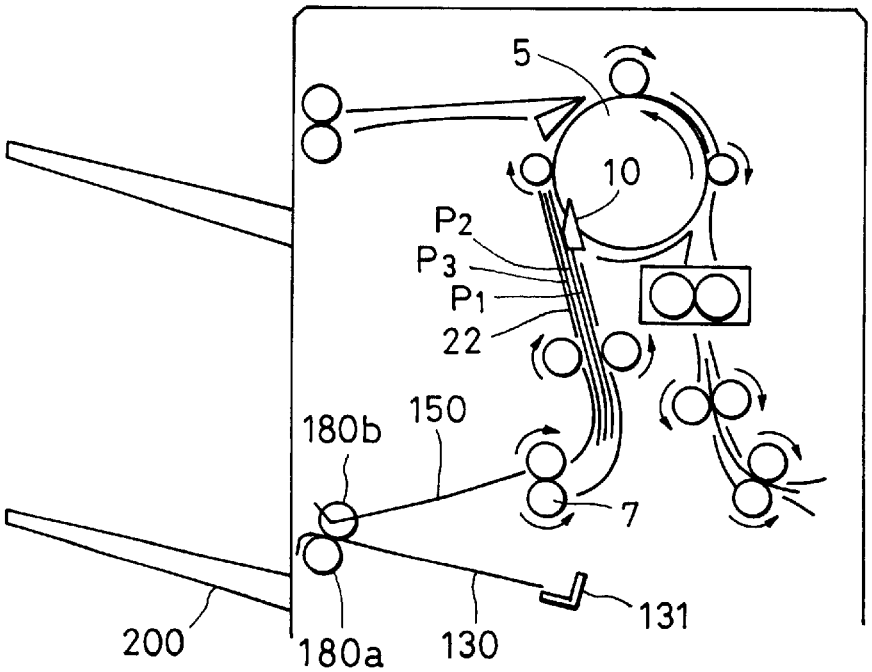

Furthermore, a sheet $P_1$ ejected from the image forming apparatus 300 during this time is wound onto the buffer roller 5 by switching operation of the second switch flapper 10, as shown in FIG. 19, is advanced by a predetermined distance from the buffer path sensor 32, and is caused to stand by thereat because the buffer roller 5 stops. At the position where the leading end of the next sheet $P_2$ is advanced by a predetermined distance from the input sensor 31, the first sheet $P_1$ and the second sheet $P_2$ are overlapped with the second sheet $P_2$ preceding the first sheet $P_1$ by a predetermined length, as shown in FIG. 20, and are wound again on the buffer roller 5, as shown in FIG. 21. Furthermore, a third sheet $P_3$ is similarly wound on the buffer roller 5. After that, as shown in FIG. 22, the three sheets $P_1$, $P_2$, and $P_3$, which are thus overlapped with the leading ends thereof being offset from each other by a predetermined length, are conveyed to the sort path 22 by switching the second switch flapper 10 again.

Figure 23:
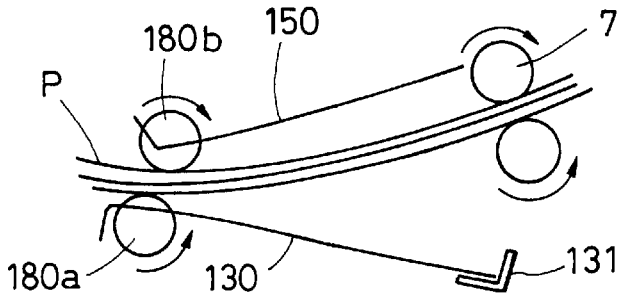
Figure 24:
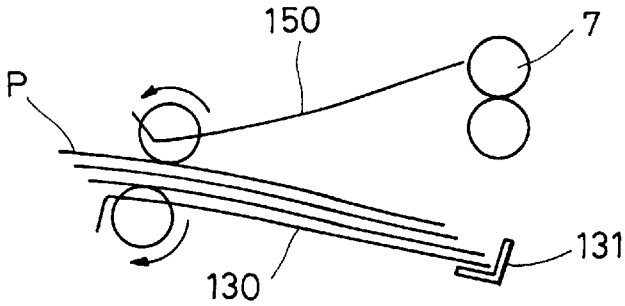
FIGS. 24 to 28 are operational views of the sheet handling device in a sort mode.
Figure 25A:
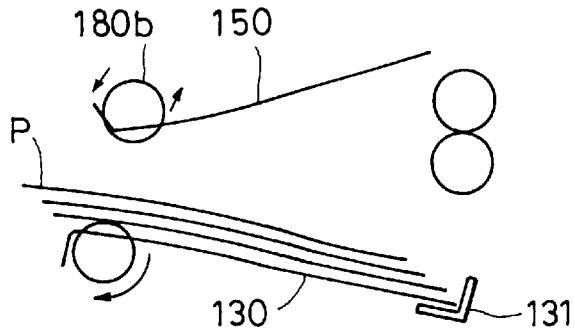
Figure 25B:
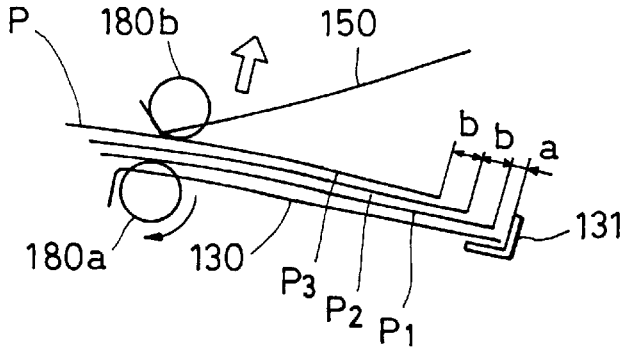

At this time, the operation of ejecting the above-described stack of sheets has been completed. The stack ejection rollers 180*a* and 180*b* rotating in the ejecting direction temporarily receive the three conveyed sheets $P_1$, $P_2$, and $P_3$ while the pivoting guide 150 is closed, as shown in FIG. 23. When the terminal end of the three sheets P makes contact with the surface of the handling tray 130 through the first ejection rollers 7*a* and 7*b*, the stack ejection rollers 180*a* and 180*b* move in reverse to move the three received sheets P back, as shown in FIG. 24. Before the terminal end of the three sheets P makes contact with the surface of the rear end stoppers 131*a*, for example, when the terminal end of the three sheets P offset from one another by a distance "b" reaches the point at a distance "a" from the surfaces of the rear end stoppers 131*a*, as shown in FIG. 25B, the pivoting guide 150 is opened to separate the stack ejection rollers 180*a* and 180*b*, as shown in FIG. 25A. The fourth and subsequent sheets P are ejected into the handling tray 130 through the sort path 22 in a manner similar to the first stack. The third and subsequent stacks of sheets are subjected to the same operation as that of the second stack, and the process is completed when a preset number of stacks are placed in the stack tray 200.

As described above, a plurality of overlapping sheets are offset in the feeding direction during the feeding. That is, the sheet $P_2$ is offset downstream from the sheet $P_1$, and the sheet $P_3$ is offset downstream from the sheet $P_2$. The amount of offset between the sheets P and the timing of separation of the rollers 180*a* and 180*b* by the pivoting guide 150 (upward movement) depend on the aligning time of the sheets P according to the return speed of the stack ejection rollers 180*a* and 180*b*, that is, they are determined based on the processing ability of the image forming apparatus. In this embodiment, when the sheet feeding speed is 750 mm/s, the offset amount "b" is approximately 20 mm, and the return speed of the stack ejection rollers 180*a* and 180*b* is 500 mm/s, the stack ejection rollers 180*a* and 180*b* are set to be separated from each other at the time where the terminal end of the sheet $P_1$ reaches the position approximately 40 mm (the distance "a") before the surfaces of the rear end stoppers 131.

Description of Sort Mode

Figure 26:
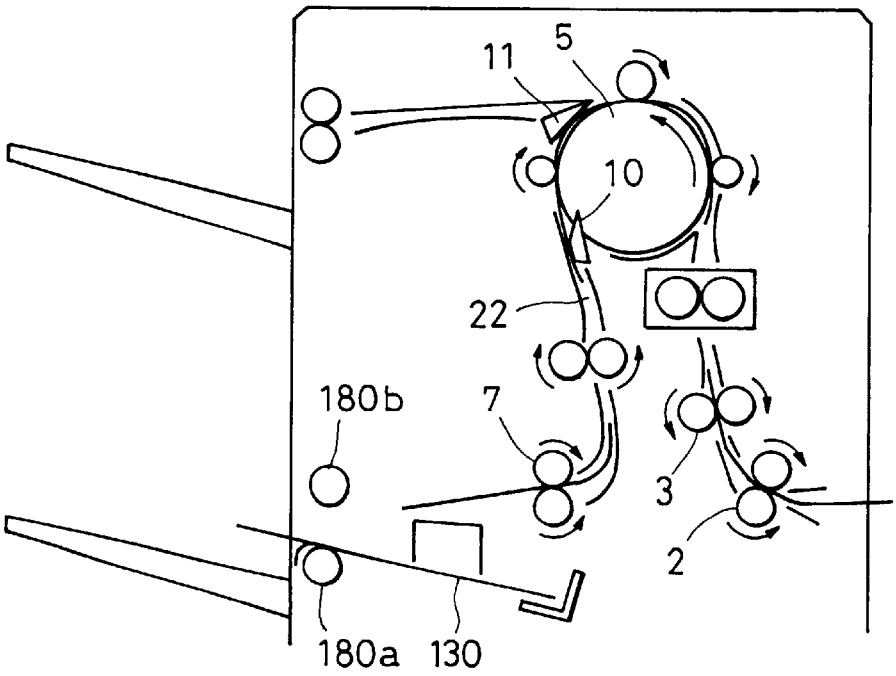
Figure 27:
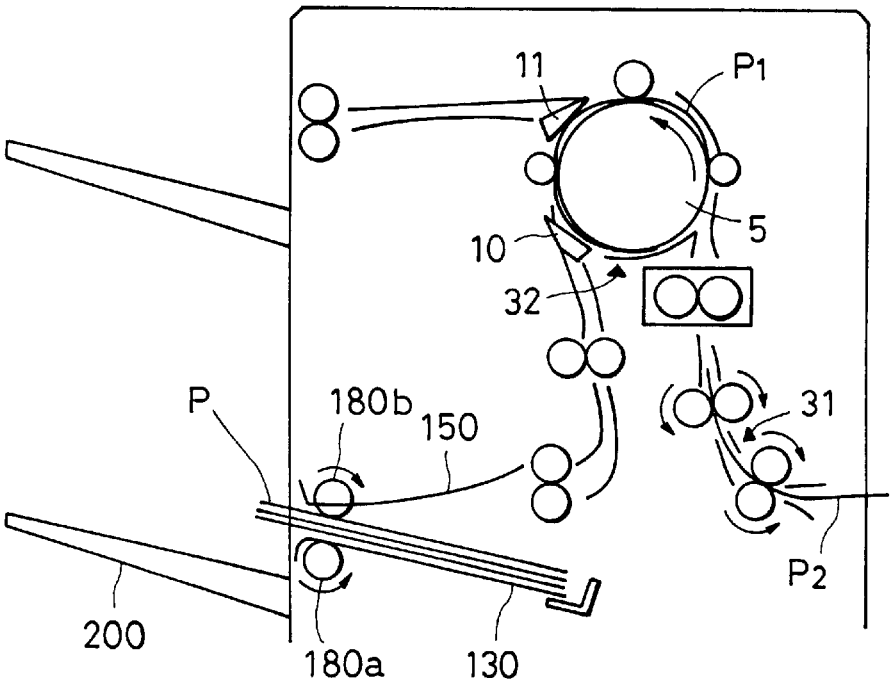

The user places a document in the image reading section of the image forming apparatus, selects a sort mode through a control portion (not shown), and then presses a start key (not shown). The input rollers 2 and the first feeding rollers 3 thereby convey sheets, as shown in FIG. 26, in a manner similar to the staple-and-sort mode, and place the sheets into the handling tray 130. After the aligning means 140 stacks a few sheets in the handling tray 130 while aligning the sheets, the pivoting guide 150 moves down to the closing direction, as shown in FIG. 27, and the sheets are thereby conveyed in a stack.

The next conveyed sheets P are wound on the buffer roller 5 in a manner similar to the staple-and-sort mode, and are ejected into the handling tray 130 which has ejected the stack of sheets. A preferable number of sheets to be ejected in a stack is equal to or less than 20, based on the results of experiments. This number is set to satisfy the following condition:

$$\text{number of documents} \geqq \text{number of sheets to be ejected in a stack} \leqq 20$$

Accordingly, if the number of sheets to be ejected in a stack is set at 5 in programming, when the number of documents is four, sheets are ejected in stacks of four sheets. When the number of documents is equal to or greater than 5, for example, 14, sheets are sorted into a stack of 5 sheets, a stack of 5 sheets, and a stack of 4 sheets, and are aligned and ejected in stacks.

Figure 28:
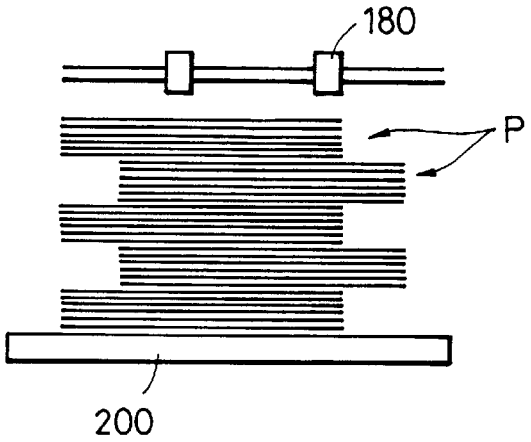

After the first stack of sheets is completely ejected, the left aligning member 141 moves together with the right aligning member 142 so that the aligning position for the second stack is offset from the aligning position for the first stack (this operation will be described in detail later). The second stack of sheets is aligned at the offset position and is ejected in a stack of a few sheets in a manner similar to the first set. After the ejection of the second stack is completed, the aligning members 141 and 142 return to the positions where they aligned the first stack so as to align the third stack. These operations are repeated for all the number of stacks with the sheet stacks being offset from one another, as shown in FIG. 28. The operation of pulling the knurl belts 190, the operation of turning the pull-in paddle 160, and the aligning operation are the same as those in the staple-and-sort mode.

Description of Alignment and Stapling

Figure 29:
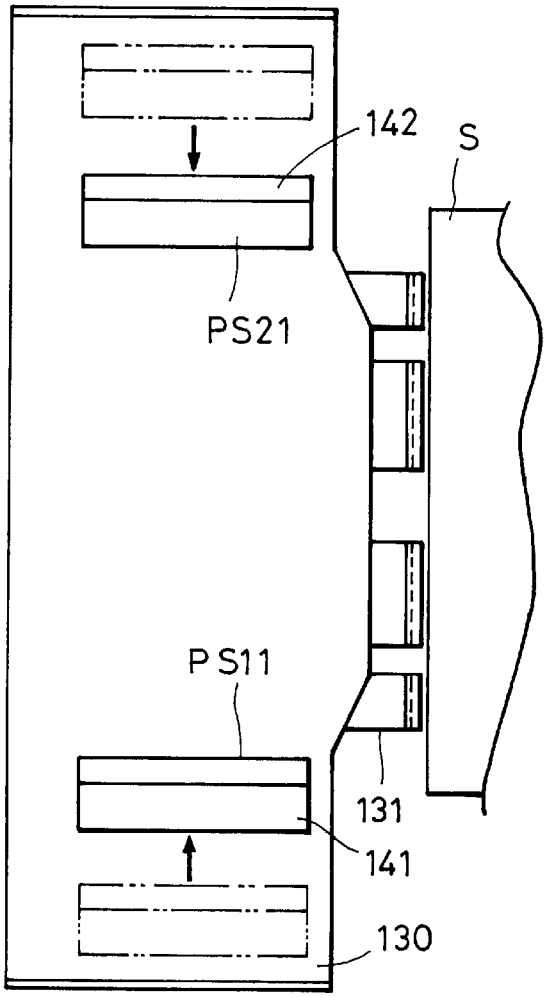
FIGS. 29 to 30 are plan views of the handling tray showing an operation of aligning a stack of sheets.

When no sheet is placed in the handling tray 130, that is, the first (three) sheets in the job are ejected, the left and right aligning members 141 and 142, which have stood by at the home positions, are previously moved to the positions PS11 and PS21 slightly offset outward from the width of the sheets P to be ejected, as shown in FIG. 29.

Figure 30:
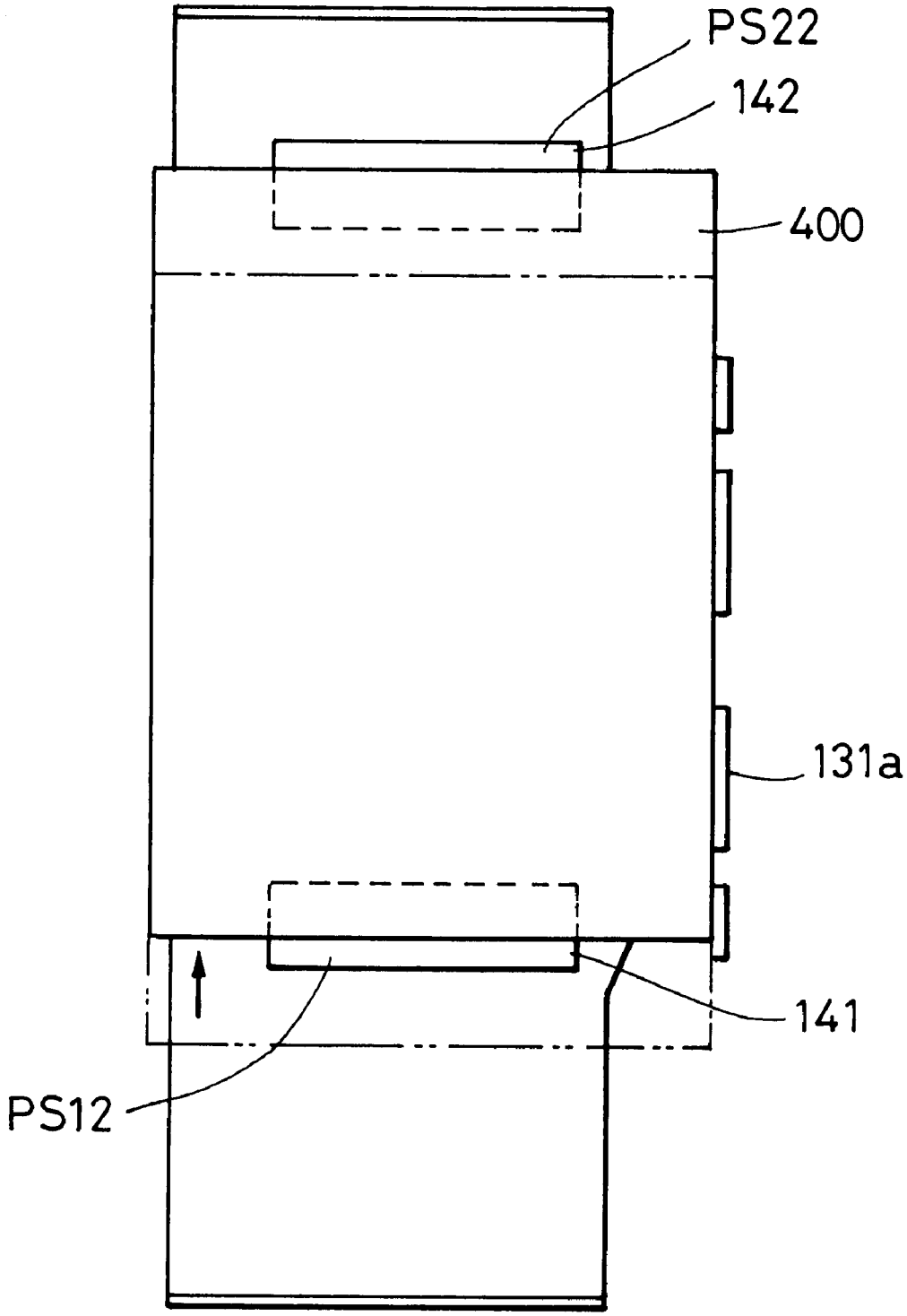

When the three sheets P are supported at the rear ends by the rear end stoppers 131*a*, and on the lower surface by the support surfaces 141*c* and 142*c* of the aligning members 141 and 142, as described above, the aligning members 141 and 142 are moved to the positions PS12 and PS22 shown in FIG. 30 so as to move the sheets P to the first aligning position 400 and to align the sheets P. Subsequently, one of the aligning members 141 returns to the position PS11 to be ready for the next sheets to be ejected. After the ejection, the aligning member 141 moves again to the position PS12 so as to shift the ejected sheets to the first aligning position 400, and to align the sheets.

Figure 31:
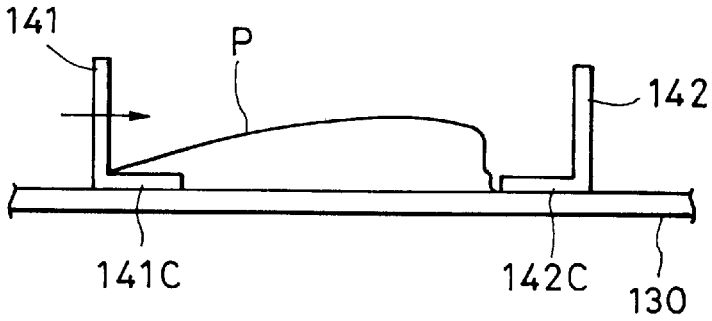
FIG. 31 is a front view of the handling tray showing the aligning operation.

In this case, the other aligning member 142 remains at the position PS22 to serve as the reference position. The above-described operations are repeated to the last sheet of the stack. Since the aligning operation is performed in this way, there is no fear that, for example, buckling will be caused by collision of the end of a moving sheet with the end of the support surface 142*c*, or the like, as shown in FIG. 31.

The first stack of sheets subjected to alignment are stapled as necessary, are ejected, and are transferred into the stack tray 200.

Figure 32:
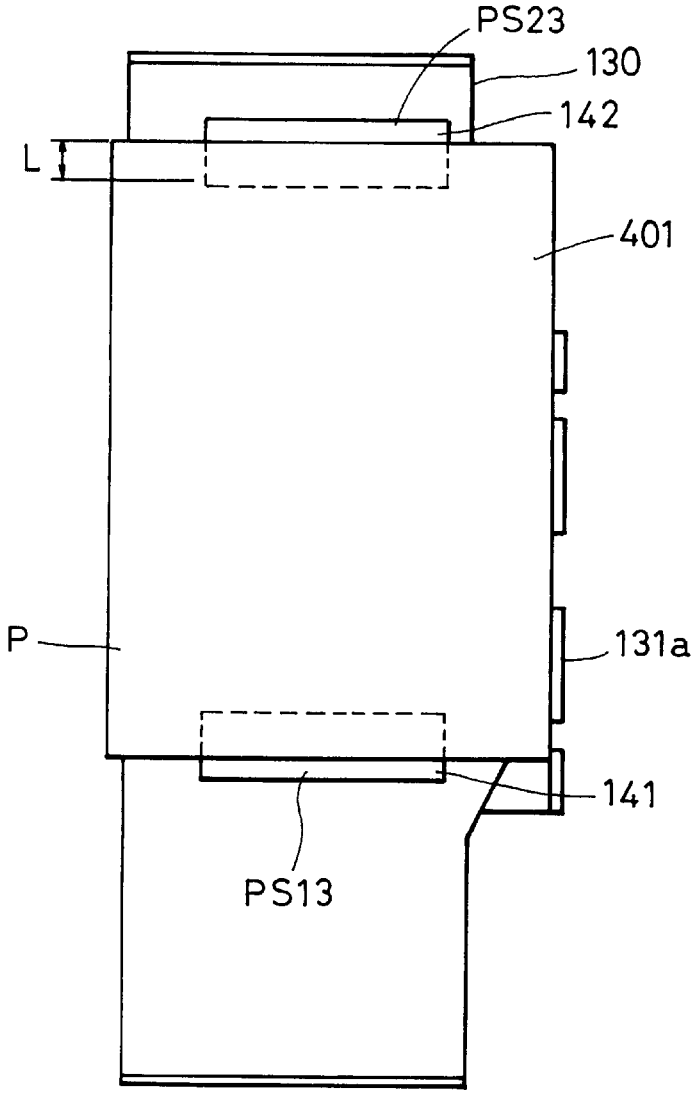
FIG. 32 is a plan view of the handling tray showing the aligning operation.

Subsequently, the second stack of (three) sheets are ejected into the handling tray 130. In this case, even when the aligning members 141 and 142 stand by at the positions PS11 and PS21 in a manner similar to the case of the first stack, they perform the aligning operation at the second aligning position 401. The second aligning position 401 is offset to the right by a predetermined length L from the first aligning position 400, as shown in FIG. 32.

That is, subsequent stacks of sheets are placed into the stack tray 200 while changing the aligning position from stack to stack, which allows the sheets to be sorted offset from each other by the length L.

The offset length L may differ between the sort mode and the staple mode. For example, a length $L_1$ (approximately 15 mm) is adopted in the staple mode to prevent staples in the adjoining stacks from overlapping, and a length $L_2$ (approximately 26 mm to 30 mm) is adopted in the sort mode to improve visibility for distinguishing among the stacks. This reduces the moving distance for alignment in the staple mode, and thereby improves the handling speed.

In the staple mode, the stapler 101 stands by at a desired clinching position for a stack of sheets to be aligned, and staples the sheets at the completion of the ejection and alignment of the last sheet of the stack. While the sheet stack aligning position changes from stack to stack by the offset length L, as described above, the stapler 101 also moves in accordance with this change.

The stapler 101 moves to change its orientation according to the fastening modes (diagonal fastening at the left side end, diagonal fastening at the right side end, fastening at two points), as described above. In the above structure, however, there are limitations to the range where the same stapling position (horizontal and tilting states) can be maintained. Furthermore, there are a variety of widths of sheets to be stapled, and stapling is sometimes impossible at the same aligning position in different fastening modes. Therefore, the first and second aligning positions 400 and 401 may be changed according to the fastening modes.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet handling device comprising:

ejection means for ejecting sheets;

a stacking surface having a stopper portion for supporting the ends of the sheets, on which the sheets ejected by said ejection means are stacked;

a rotatable feeding member that moves the sheets in a sheet-feeding direction toward said stopper portion of said stacking surface;

aligning means for aligning the sheets on said stacking surface by moving the sheets in the direction orthogonal to the sheet feeding direction;

shift means for moving said rotatable feeding member between an acting position and a retracted position; and control means that projects said rotatable feeding member to the acting position and that retracts said rotatable feeding member to the retracted position, wherein said rotatable feeding member is retracted to the retracted position during an aligning operation by said aligning means, and wherein said rotatable feeding member, when in the acting position, acts on the surface of the sheets on said stacking surface and, when in the retracted position, reduces the force acting on the surface of the sheets on said stacking surface or separates from the surface of the sheets on said stacking surface.

2. A sheet handling device according to claim 1, wherein said shift means comprises pulling means, and said pulling means retracts said rotatable feeding member to the retracted position by pulling said rotatable feeding member so that it is not in contact with the sheets on said stacking surface.

3. A sheet handling device according to claim 1, wherein said shift means comprises pulling means, and said pulling means retracts said rotatable feeding member to the retracted position by pulling said rotatable feeding member so that it is in slight contact with the sheets on said stacking surface.

4. A sheet handling device according to any one of claims 1 to 3, wherein said aligning means performs a pushing operation to push the sheets to an aligned position, and a reverse operation to separate from the aligned position, and wherein said rotatable feeding member is shifted to the retracted position during the pushing operation of said aligning means and to the acting position during the reverse operation of said aligning means.

5. A sheet handling device according to claim 4, further comprising counting means for counting the number of sheets ejected on said stacking surface, wherein said control means retracts said rotatable feeding member to the retracted position when the number of sheets on said stacking surface counted by said counting means exceeds a predetermined number.

6. A sheet handling device according to claim 5, wherein said rotatable feeding member is a belt supported on the rotation shaft of said ejection means and rotates together with said ejection means.

7. A sheet handling device according to claim 6, wherein said stacking surface is inclined so that said stopper portion is on a lower portion of said stacking surface, and wherein the ejected sheets also move toward said stopper portion due to their own weight.

8. A sheet handling device according to claim 7, further comprising a paddle for moving the ejected sheets in a sheet-feeding direction toward said stopper portion.

9. An image forming apparatus comprising:

a sheet handling device;

image forming means for forming an image on a sheet; and main body ejection means for ejecting sheets having thereon images formed by said image forming means, wherein said sheet handling device comprises:

ejection means for ejecting sheets;

a stacking surface having a stopper portion for supporting the ends of the sheets, on which the sheets ejected by said ejection means are stacked;

a rotatable feeding member that moves the sheets in a sheet-feeding direction toward said stopper portion of said stacking surface;

aligning means for aligning the sheets on said stacking surface by moving the sheets in the direction orthogonal to the sheet-feeding direction;

shift means for moving said rotatable feeding member between an acting position and a retracted position; and control means that projects said rotatable feeding member to the acting position and that retracts said rotatable feeding member to the retracted position, wherein said rotatable feeding member is retracted to the retracted position during an aligning operation by said aligning means, and wherein said rotatable feeding member, when in the acting position, acts on the surface of the sheets on said stacking surface and, when in the retracted position, reduces the force acting on the surface of the sheets on said stacking surface or separates from the surface of the sheets on said stacking surface.

10. An image forming apparatus according to claim 9, wherein said shift means comprises pulling means, and said pulling means retracts said rotatable feeding member to the retracted position by pulling said rotatable feeding member so that it is not in contact with the sheets on said stacking surface.

11. An image forming apparatus according to claim 9, wherein said shift means comprises pulling means, and said pulling means retracts said rotatable feeding member to the retracted position by pulling said rotatable feeding member so that it is in slight contact with the sheets on said stacking surface.

12. An image forming apparatus according to any one of claims 9 to 11, wherein said aligning means performs a pushing operation to push the sheets to an aligned position, and a reverse operation to separate from the aligned position, and wherein said rotatable feeding member is shifted to the retracted position during the pushing operation of said aligning means and to the acting position during the reverse operation of said aligning means.

13. An image forming apparatus according to claim 12, further comprising counting means for counting the number of sheets ejected on said stacking surface, wherein said control means retracts said rotatable feeding member to the retracted position when the number of sheets on said stacking surface counted by said counting means exceeds a predetermined number.

14. An image forming apparatus according to claim 13, wherein said rotatable feeding member is a belt supported on the rotation shaft of said ejection means and rotates together with said ejection means.

15. An image forming apparatus according to claim 14, wherein said stacking surface is inclined so that said stopper portion is on a lower portion of said stacking surface, and wherein the ejected sheets also move toward said stopper portion due to their own weight.

16. An image forming apparatus according to claim 15, further comprising a paddle for moving the ejected sheets in a sheet-feeding direction toward said stopper portion.

* * * * *